US005153105A

United States Patent [19]

Sher et al.

[11] Patent Number: 5,153,105

[45] Date of Patent: Oct. 6, 1992

[54] THERMALLY DEVELOPABLE LIGHT SENSITIVE IMAGEABLE LAYERS CONTAINING PHOTOBLEACHABLE DYES

[75] Inventors: Frank T. Sher; Mitchell A. Rossman, both of St. Paul, Minn.

[73] Assignee: Minnesota Mining and Manufacturing Company, St. Paul, Minn.

[21] Appl. No.: 539,572

[22] Filed: Jun. 18, 1990

[51] Int. Cl.[5] ..... G03C 1/73

[52] U.S. Cl. ..... 430/339; 430/336; 430/338; 430/340; 430/341; 430/344

[58] Field of Search ..... 430/336, 338, 344, 340, 430/341, 339

[56] References Cited

U.S. PATENT DOCUMENTS

| | | | |
|---|---|---|---|
| 3,647,433 | 3/1972 | Contois | 430/82 |
| 3,988,156 | 10/1976 | Sturmer | 430/522 |
| 4,271,263 | 6/1981 | Goeltert | 430/513 |
| 4,370,401 | 1/1983 | Winslow et al. | 430/339 |
| 4,379,835 | 4/1983 | Lonrey et al. | 430/338 |
| 4,460,677 | 7/1984 | Smith et al. | 430/336 |
| 4,677,049 | 6/1987 | Griffing et al. . | |
| 4,701,402 | 10/1987 | Patel et al. | 430/332 |

*Primary Examiner*—Charles L. Bowers, Jr.
*Assistant Examiner*—Thorl Chea
*Attorney, Agent, or Firm*—Gary L. Griswold; Walter N. Kirn; Mark A. Litman

[57] ABSTRACT

Photothermographic imageable layers comprise a photobleachable dye, a nitrate salt, a leuco dye, a binder, and an optional organic acid. These systems may be used in a variety of applications comprising single or multiple layers in either single or multiple sheet constructions to provide color imaging elements.

22 Claims, No Drawings

THERMALLY DEVELOPABLE LIGHT SENSITIVE IMAGEABLE LAYERS CONTAINING PHOTOBLEACHABLE DYES

CROSS-REFERENCE TO RELATED CASES

This case is related to "Light Sensitive Elements", U.S. Ser. No. 83,522 filed Aug. 7, 1987, continued as U.S. Ser. No. 394,240, filed Aug. 11, 1989.

BACKGROUND TO THE INVENTION

1. Field of the Invention

The present invention relates to light sensitive imageable layers, and in particular to photothermographic imageable layers comprising a nitrate salt, a leuco dye, a photobleachable dye, a binder, and an optional organic acid.

2. Information Disclosure Statement

Many processes and compositions use leuco dyes to provide optical densities in the imaged article. For example, U.S. Pat. No. 4,017,313 uses a combination of a photosensitive leuco dye, a photosensitizer for the dye, an aromatic aldehyde and a secondary or tertiary amine. Other photosensitive systems using leuco dyes are included in U.S. Pat. Nos. 3,390,997, 2,884,326, and 2,772,284. The mechanism of these last two patents is disclosed in "Aromatic Aldehyde-Leuco Dye Photooxidation" H. D. Hartzler, *Pure Appl. Chem.* 1979, 49, pp 353–356.

*Light-Sensitive Systems*, (Kosar, J.; John Wiley and Sons: New York, 1965, p 369), describes print-out photosensitive systems comprising a binder, leuco dye, organic halogen-releasing compound and a photosensitizing dye. Because these are printout systems, there is no thermal amplification.

A great many photosensitive materials have been used in different imaging processes utilizing various photoinitiated phenomena such as photohardening of polymerizable materials (e.g., negative acting printing plates, photosolubilizing materials (e.g., positive acting printing plates), light initiated diazonium salt coupling reactions (e.g., diazonium microfilm), etc. A class of iodonium photoinitiators for both cationic and epoxy polymerization (e.g., U.S. Pat. Nos. 4,026,705 and 3,981,897), has also been proposed as equivalent to other photoinitiators in certain ethylenically unsaturated printing plate compositions (e.g., U.S. Pat. No. 3,741,769).

Photothermographic imaging systems are well known in the art. By definition, photothermographic systems are light sensitive imaging systems which are thermally developed. Photothermographic systems typically require development temperatures in the range of 80° to 200° C. A number of imaging systems employ photosensitive compounds, leuco dyes or bleachable dyes, and nitrate salts to generate color images.

Imaging systems, which are sensitive to ultraviolet (UV) light, comprising a leuco dye or bleachable dye, nitrate ion, and diazonium salts in a binder are disclosed in U.S. Pat. No. 4,370,401. In those cases wherein a leuco dye system is employed, a photothermographic, negative acting imaging system is provided; that is, the optical density in the final image is more dense in areas which are light struck than in areas which are not light struck. Conversely, in those cases wherein a bleachable dye system is employed, a photothermographic, positive acting imaging system is provided. That is, the optical density in the final image is more dense in areas which are not light struck than in areas which are light struck. The bleachable dye used in these cases does not serve in the role of a sensitizer or photoinitiator.

Related imaging compositions comprising a diazonium salt and leuco dye in a binder is disclosed in U.S. Pat. No. 4,394,433. These unamplified compositions are positive-acting photothermographic compositions, and differ fundamentally from the compositions of the present invention, which are amplified by the action of a nitrate salt.

Additional light sensitive, thermally developable imaging systems are known. U.S. Pat. No. 4,460,677 describes a thermally developable imaging system comprising a leuco dye, nitrate ion, and a spectrally sensitized organic compound having photolyzable halogen atoms. Similarly, U.S. Pat. No. 4,386,154 describes a thermally developable imaging system comprising a leuco dye, a nitrate ion, and a spectrally sensitized compound selected from (1) aromatic iodonium salts and (2) compounds containing photolyzable halogen atoms. Both of these compositions act as a negative image forming systems in that the greatest image density is formed upon heat development in the light struck areas. The latent images are formed upon exposure to visible light and images are formed by heat development. The color fidelity and contrast of both of these systems is reduced by the presence of sensitizer stain, that is color due to unreacted sensitizer in regions not light exposed, and to colored by-products from reacted sensitizer in light exposed regions. This sensitizer stain aesthetically detracts from the image. Further, the presence of (1) aromatic iodonium salts, or (2) compounds containing photolyzable halogen atoms generally leads to image printout on standing under ambient conditions on a time scale of minutes to days.

Light sensitive, thermally developable imaging systems are also described in several Japanese Patents.

Japanese Pat. No. 77,025,330 pertains to a UV light sensitive two component positive acting imaging composition comprised of an oxazine or phenothiazine leuco dye (BLMB), mono or disubstituted with a dialkylamino group, and an oxidizing agent such as nitrate ion.

Japanese Pat. No. 77,004,180 describes the use of triplet sensitizers for BLMB. Suitable sensitizers are aromatic carbonyl compounds and aromatic nitro compounds. Said patent describes both negative and positive systems, and is a counterpart to Japanese Pat. No. 77,025,330. The compositions described therein are UV light sensitive whereas the compositions of this invention are visible light sensitive through the entire visible spectrum of 400–700 nm. The compounds described are not equivalent to the compounds used in this invention.

Japanese Pat. No. 76,035,847 describes photosensitive heat fixable recording materials containing a free radical producing organic halogen compound, leuco dye and a base. This is a negative acting system which contains no oxidizer.

Japanese Pat. No. 77,025,088 describes photosensitive compositions containing an acid sensitive leuco dye (e.g., naphthospiropyran), a photochemical acid generating agent which is a mixture of an organic halide (e.g., $CBr_4$), with a furan containing compound.

Japanese Pat. No. 79,001,453 describes a photothermographic material which contains an oxidizer, a compound which reacts with the oxidizer to change or develop color, and a compound which deactivates the color developer either in exposed or unexposed regions.

Images can be either positive or negative, and do not employ sensitizers or diaryliodonium salts or organic compounds having photolyzable halogen atoms, which are components of the present invention, and which activate rather than deactivate color development. The light sensitive materials used were colorless or nearly colorless aryl quinones and ultraviolet light sources were used. Additionally, the light sensitive materials used were not photobleachable.

Decolorizable imaging systems comprising a binder, nitrate salt, acid, and dyes are disclosed in U.S. Pat. Nos. 4,336,323 and 4,373,020. These systems are particularly useful as antihalation layers in photothermographic systems where the development temperature acts to bleach the dye.

The use of photobleachable dyes including o-nitroarylidene dyes as antihalation or acutance dyes is known in the art: U.S. Pat. Nos. 4,111,699; 4,271,263; 4,088,497; 4,033,948; 4,028,113; 3,988,156; 3,988,154; 3,984,248; 3,615,432 (RE28,225). The use of photobleachable dyes in this manner is unrelated to their function in the present invention. Additionally, it was found that o-nitroarylidene dyes are desensitizing to silver halide imaging systems.

Spectral sensitization of silver-containing photothermographic compositions has been disclosed in U.S. Pat. No. 4,461,828.

U.S. Pat. No. 4,713,312 teaches the use of photobleachable sensitizers in the range of 390–500 nm for free radical polymerization to reduce background sensitizer stain in an imaging system based on photosensitive microcapsules. Said patent does not provide for complete removal of residual sensitizer stain since sensitizers used in it covering the range 500–700 nm, necessary for full color reproduction, are not photobleachable, and hence add stain to the background in unirradiated areas.

SUMMARY OF THE INVENTION

Briefly, this invention provides photothermographic imageable layers comprising a nitrate salt, a leuco dye, photobleachable dye, a binder, and an optional organic acid.

This invention provides imageable layers comprised of a nitrate salt, a leuco dye, and a photobleachable dye. These compositions are normally carried by a binder such as a polymeric binder which may also contain an organic acid.

The imageable layers of this invention have reduced residual sensitizer stain both in exposed regions of the composition, and following an optional post-development blanket irradiation, in unexposed regions as well. Further, subsequent exposure of said blanket irradiated imageable layer to ammonia vapor serves to thermally stabilize (fix) said layer.

Sensitivity to visible light (that is the exposure necessary to enable the generation of images) of less than $5\times10^4$ ergs/cm$^2$ and even less than $5\times10^3$ ergs/cm$^2$ is readily attained with the compositions of the present invention, and clearly shows that amplification is occurring.

This invention provides a negative-acting photothermographic imaging system which produces clean and stable images by overcoming the deficiencies of the prior art which are (1) the need to sensitize a UV sensitive photoinitiator, and (2) image instability (printout), caused by thermal interaction of said UV sensitive photoinitiator with the leuco dye.

This invention is achieved by providing a novel photothermographic imageable layer which comprises a binder, leuco dye, nitrate ion, photobleachable dye, and an optional organic acid. After exposing the system to light, the application of heat develops the image by oxidizing the leuco dye more rapidly in either the exposed or unexposed region to afford a negative positive image, respectively. An image results due to a differential rate of oxidation occurring in exposed and unexposed regions. Latent images are formed upon exposure to visible light and stable images are then formed by heat development, a subsequent optional blanket light exposure, and a subsequent exposure to ammonia vapor. No wet processing steps are needed.

DETAILED DESCRIPTION OF THE INVENTION

There are a minimum of four components to the imageable layers of the present invention. The four required ingredients are (1) a photobleachable dye, (2) a nitrate salt, (3) a leuco dye, and (4) a polymeric resin (binder). An acidic material constitutes a preferred fifth ingredient.

Photobleachable Dye

The term photobleachable means that upon exposure to actinic radiation between about 350 nm and about 1100 nm the dye is converted to a colorless or nearly colorless form (i.e., the molar absorptivity is reduced by at least a factor of 5). Photobleachable sensitizers useful in the present invention bleach at least 10%, and preferably bleach at least 25% and more preferably at least 50% when exposed to the following conditions:

a film of polyethylene terephthalate (4 mil thickness) is coated with the sensitizer in question so as to create a colored film with an absorbance of from 0.1 to 0.6, whereupon said colored film is then placed onto the Fresnel lens of a 3M brand Model 213 Overhead Projector and exposed to light therefrom for 5 minutes.

The photobleachable sensitizers are said to bleach at a given percentage when the layer containing the sensitizer decreases absorbance (absorption intensity) by a given percentage at the longest wavelength absorption band maximum. This absorbance may be measured either by percentage reduction in optical density provided by the sensitizer or by measurement of the percentage of radiation actually absorbed.

The overhead projector uses a single General Electric 82V ENX 360W projection bulb having a color temperature of 33300° K. The light intensity on the mage stage is 0.46 W/cm$^2$±0.05 W/cm$^2$.

Compounds useful as photobleachable dyes of this invention include, but are not limited to o-nitro-substituted arylidene dyes and aryl nitrone dyes. As employed herein the term "arylidene" refers to a group formed by an aryl group and a methine linkage (e.g., benzylidene, cinnamylidene, etc.). o-Nitro-substituted arylidene dyes contain an o-nitro-substituted aryl group joined through a methine chain linkage to a basic heterocyclic nucleus containing an electron-donating atom, typically a nitrogen, oxygen, or sulfur. The number of atoms joining the electron donating atom and the aryl group is an even or odd number.

In a preferred embodiment, the o-nitro-substituted aryl group is joined through an acyclic methine chain containing an even or odd number of methine groups to a 5- or 6-membered basic, cyanine dye-type heterocyclic nucleus. The heterocyclic nucleus can have additional carbocyclic and heterocyclic rings fused thereto. The o-nitro-substituted aryl group can contain a phenyl or heterocyclic nucleus, or can contain a nucleus formed by fused aromatic or heteroaromatic rings, such as naphthyl and the like. U.S. Pat. Nos. 3,984,248, 3,988,154, 3,988,156, and 4,271,263 disclose certain members of the o-nitroarylidene dyes as acutance agents in thermally-developable photosensitive compositions. U.S. Pat. No. 4,095,981 discloses certain members of the o-nitroarylidene dyes as energy sensitive dyes in silver based photographic or photothermographic materials.

In a specific preferred embodiment of this invention, the o-nitro-substituted dyes have three general formulas. Formula 1 is:

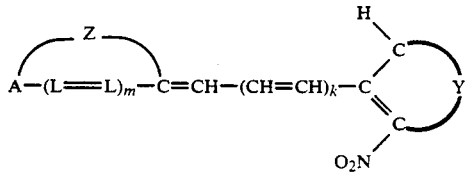

wherein k represents 0 or 1;

m represents 0 or 1;

L represents a methine group, including substituted methine groups (e.g., —CH=, —C(CH3)=, etc.);

A represents an electron donating moiety, such as oxygen (—O—), sulfur (—S—), or

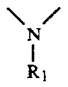

$R_1$ represents (1) an alkyl group having from 1 to 18 carbon atoms and preferably a lower alkyl group having from 1 to 4 carbon atoms (e.g., methyl, ethyl, propyl, isopropyl, butyl, sec-butyl, isobutyl, tert-butyl); a sulfoalkyl group, preferably sulfo lower alkyl containing from 1 to 4 carbon atoms in the alkyl moiety (e.g, β-sulfoethyl, γ-sulfopropyl, γ-sulfobutyl, etc.); a carboxyalkyl group, preferably a carboxy lower alkyl containing from 1 to 4 carbon atoms in the alkyl moiety (e.g., β-carboxyethyl, γ-carboxypropyl, δ-carboxybutyl, etc.); a sulfatoalkyl group, preferably a sulfato lower alkyl containing 1 to 4 carbon atoms in the alkyl moiety (e.g., β-sulfatoethyl, γ-sulfatopropyl, δ-sulfatobutyl, etc.); an alkoxyalkyl group, preferably a lower alkoxy lower alkyl containing from 1 to 4 carbon atoms in both the alkoxy and alkyl moieties (e.g., β-methoxyethyl, γ-methoxypropyl, δ-propoxybutyl, etc.); an acyloxyalkyl group preferably an acyloxy lower alkyl containing from 1 to 4 carbon atoms in the alkyl moiety (e.g., acetyloxyethyl, propanoyloxyethyl, butanoyloxybutyl, benzoyloxyethyl, toluyloxypropyl, etc.); an alkoxycarbonylalkyl group, preferably a lower alkoxy carbonyl lower alkyl containing from 1 to 4 carbon atoms in both the alkoxy and alkyl moieties (e.g., β-methoxycarbonylethyl, δ-ethoxycarbonylbutyl, β-butoxycarbonylethyl, etc.); a dialkylaminoalkylene group, preferably a di-lower alkylamino lower alkylene containing from 1 to 4 carbon atoms in the alkylene and the alkyl moieties (e.g., dimethylaminoethylene, diethylaminopropylene, diethylaminobutylene, etc.); a cycloaminoalkylene group, preferably cycloamino lower alkyl containing 4 to 6 atom in the cycloamino moiety and 1 to 4 atoms in the alkyl moiety (e.g., pyrrolidinylethylene, morpholinopropylene, piperidinebutylene, pyrrolidinylmethylene, etc.); (2) an alkenyl group (including a substituted alkenyl group), preferably a lower alkenyl containing 2 to 4 carbon atoms (e.g., ethyl, allyl, 1-propenyl, 1-butenyl, 2-butenyl, etc.); or (3) an aryl group (including a substituted aryl), such as phenyl, naphthyl, tolyl, xylyl, halophenyl (e.g., p-chlorophenyl, p-bromophenyl, etc.), alkoxyphenyl (such as methoxyphenyl, 2,4-dichlorophenyl, etc.), and an alkyl group, preferably an aryl lower alkyl containing from 1 to 4 carbon atoms in the alkyl moiety (e.g., benzyl, β-phenethyl, o-phenbutyl, etc.); or (4) hydrogen; and Y represents the atoms necessary to complete an aryl (preferably phenyl or naphthyl) ring which is o-nitro-substituted and preferably is also p-substituted with a nitro or other electron withdrawing group and which can have other substituents attached to it and other carbocyclic rings fused to it (e.g., 2-nitrophenyl, 2,4-dinitrophenyl, 2,6-dinitrophenyl, 2,4,6-trinitrophenyl, 2-nitronaphthyl, 2,4-dinitronaphthyl, 2-nitro-4-cyanophenyl, 2-nitro-4-ethoxycarbonylphenyl, 2-nitro-4-trifluoromethylphenyl, and the like); and Z represents the nonmetallic atoms necessary to complete a heterocyclic nucleus of the type used in cyanine dyes containing 5 or 6 atoms in the heterocyclic ring containing the electron-donating atom of the formula which ring can contain a second hetero atom such as oxygen, nitrogen, selenium, or sulfur. The heterocyclic nucleus preferably is selected from the group consisting of thiazole nucleus including substituted and unsubstituted benzothiazole and naphthothiazole nuclei and like (e.g., thiazole, 4-methylthiazole, 4-phenylthiazole, 4,5-diphenylthiazole, 4-(2-thienyl)thiazole, benzothiazole, 4-chlorobenzothiazole, 4-methylbenzothiazole, 4-methoxybenzothiazole, 4-ethoxybenzothiazole, 4-phenylbenzothiazole, 5-chlorobenzothiazole, 5-bromobenzothiazole, 5-methylbenzophenylbenzothiazole, 5-methoxybenzothiazole, 5-ethoxybenzothiazole, 6-chlorobenzothiazole, 6-ethoxybenzothiazole, 5-methoxynaphtha[2,3-d]thiazole, 5-nitrobenzothiazole, 6-nitrobenzothiazole, 5-chloro-6-nitrobenzothiazole, etc.); an oxazole nucleus including substituted and unsubstituted benzoxazole and naphthoxazole nuclei and the like (e.g., oxazole, 4-phenyloxazole, benzoxazole, 5-chlorobenzoxazole, 5-methylbenzoxazole, 5-bromobenzoxazole, 5-methoxybenzoxazole, 5-ethoxybenzoxazole, 5-phenylbenzoxazole, 5-nitrobenzoxazole, 6-nitrobenzoxazole, 5-chloro-6-nitrobenzoxazole, etc.); a selenazole nucleus including substituted or unsubstituted benzoselenazole and naphtoselenazole nuclei and the like (e.g., selenazole, 4-methylselenazole, 4-nitroselenazole, 4-phenylselenazole, benzoselenazole, 5-chlorobenzoselenazole, 6-chlorobenzoselenazole, naphtho[2,1-l]selenazole, 5-nitrobenzoselenazole, 6-nitrobenzoselenazole, 5-chloro-6-nitrobenzoselenazole, nitro-group substituted naphthoselenazoles, etc.); a thiazoline nucleus (e.g., thiazoline, 4-methylthiazoline, 4-nitrothiazoline, etc.); a 2-pyridine nucleus, (e.g., 2-pyridine, 5-methyl-2-pyridine, etc.); a 4-pyridine nucleus (e.g., 4-pyridine, 3-methyl-4-pyridine, nitro-group substituted pyridines, etc.); a 3,3-dialkylindolenine nucleus (e.g., 3,3-dimethylindolenine, 3,3-diethyl-5- or 6-cyanoindolenine, 3,3-diethyl-5- or 6-nitroindolenine, 3,3-dimethyl-5- or 6-nitroindolenine, etc.); an imidazole nucleus (e.g., imidazole; 1-alkylimidazole; benzimidazole; 1,3-dialkyl, 1,3-diaryl, or 1-alkyl-3-arylimidazoles and benzimidazoles (e.g., 5-chloro-1,3-dialkylbenzimidazoles, 5-chloro-1,3-diarylbenzimidazoles, 5-methoxy-1,3-dialkylbenzimidazoles, 5 methoxy-1,3-diarylbenzimidazoles, 5-cyano-1,3-dialkylbenzimidazoles, 5-cyano-1,3-diarylbenzimidazoles, 1,3-dialkylnaphth[1,2-d]imidazole, 1,3-diarylnaphth[1,2-d]imidazole), etc.); a quinoline nucleus (e.g., quinoline, 6-methylquinoline, 6-methoxyquinoline, 6-ethoxyquinoline, 6-ethoxyquinoline, 6-chloroquinoline, 4-methoxyquinoline, 4-methylquinoline, 8-methoxyquinoline, 2-methylquinoline, 4-chloroquinoline, 6-nitroquinoline, etc.); an imidazo[4,5-b]quinoxaline nucleus (e.g., imidazo[4,5-b]quinoxaline, 1,3-dialkylimidazo[4,5-b]quinoxaline such a 1,3-diethylimidazo[4,5-b]quinoxaline, 6-chloro-1,3-diethylimidazo[4,5-b]quinoxaline, etc.; 1,3-dialkenylimidazo[4,5-b]quinoxaline such as 1,3-diallylimidazo[4,5-b]quinoxaline, 6-chloro-1,3-diallylimidazo[4,5-b]quinoxaline, etc.; 1,3-diarylimidazo[4,5-b]quinoxaline such as 1,3-diphenylimidazo[4,5-b]quinoxaline, 6-chloro-1,3-diphenylimidazo[4,5-b]quinoxaline, etc.); a 3H-pyrrolo[2,3-b]pyridine nucleus, (e.g., 3,3-dialkyl-3H-pyrrolo[2,3-b]pyridine such as 3,3-dimethyl-3H-pyrrolo[2,3-b]pyridine, 3,3-diethyl-3H-pyrrolo[2,3-b]pyridine, 1,3,3-trialkyl-3H-pyrrolo[2,3-b]pyridine such as 1,3,3-triethyl-3H-pyrrolo[2,3-b]pyridine, etc.); and a thiazolo[4,5-b]quinoline nucleus, a pyrylium (including benzopyrylium, thiapyrylium, and benzothiapyrylium) nucleus, and a dithiolinium nucleus.

Formula 2 is:

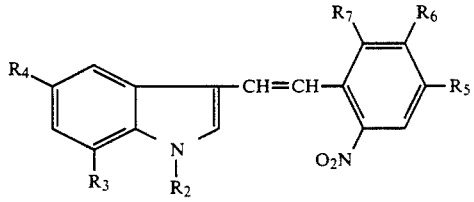

wherein $R_2$ represents hydrogen, an alkyl group of 1 to 18 carbon atoms or an aryl group of 6 to 10 carbon atoms, the alkyl or aryl group optionally substituted by halogen, by an alkoxy group of 1 to 6 carbon atoms or by an aryl group of 6 to 10 carbon atoms; and preferably $R_2$ is hydrogen;

$R_3$ and $R_4$ independently represent hydrogen, an alkyl group of 1 to 6 carbon atoms, an alkoxy group of 1 to 6 carbon atoms, or halogen:

$R_5$ represents hydrogen, nitro, cyano, a carboalkoxy group of 1 to 6 carbon atoms, or halogen;

$R_6$ and $R_7$ together constitute a benzo group.

Formula 3 is:

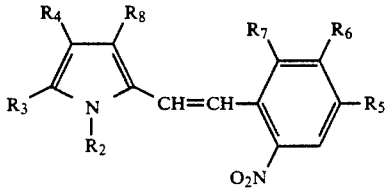

wherein $R_2$–$R_7$ are defined as above;

$R_8$ represents hydrogen, an alkyl group of 1 to 6 carbon atoms, an alkoxy group of 1 to 6 carbon atoms, or halogen.

In another specific preferred embodiment the spectrally sensitive initiator is an aryl nitrone shown by Formula 4:

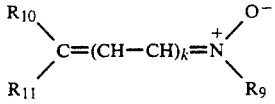

wherein k is defined as above;

$R_9$ is an aryl or substituted aryl group (e.g. phenyl, tolyl, naphthyl, anthracenyl, etc.);

$R_{10}$ and $R_{11}$ are independently chosen from an electron rich substituted aryl or heterocyclic group (e.g., p-dimethylaminophenyl, 4-methoxy-1-naphthyl, 2-furanyl, N-methylpyrrol-2-yl, thiophen-2-yl, etc.), and hydrogen, with the proviso that R11 and $R_{12}$ are not both hydrogen.

The photobleachable dye should be present as at least 0.05 percent by weight of the dried imageable layer, up to 1.5 percent by weight or more. Preferably, they are present at from 0.075 to 1.25 percent by weight of the layer and most preferably from 0.1 to 1.0 percent.

Binder

Any natural or synthetic water-insoluble polymeric binder may be used in the practice of this invention. Organic polymeric resins, preferably thermoplastic resins although thermoset resins may be used) are generally preferred. Where speed is important, water-insoluble, water impermeable, water resistant polymers should be used and an acid should be added to the system to increase the rate of colorizing (i.e., leuco dye oxidation). Such resins as phenoxy resins, polyesters, polyvinyl resins, polycarbonates, polyamides, polyvinyl acetals, polyvinylidene chloride, polyacrylates, cellulose esters, copolymers and blends of these classes of resins, and others have been used with particular success. Where the proportions and activities of leuco dyes and nitrate ion require a particular developing time and temperature, the resin should be able to withstand those conditions. Generally, it is preferred that the polymer not decompose or lose its structural integrity at 200° F. (93° C.) for 30 seconds and most preferred that it not decompose or lose its structural integrity at 260° F. (127° C). Preferred polymers include polyvinylidene chloride resins (e.g., Saran TM supplied by Dow Chemical, Midland, Mich.), phenoxy resins (e.g., PKHH TM and PAHJ TM supplied by Union Carbide, Hackensack, N.J.), and polyvinyl formals (e.g., Formvar TM supplied by Monsanto Chemical, St. Louis, Mo).

Beyond these minimal requirements, there is no criticality in the selection of a binder. In fact, even transparency and translucency are not required although they are desirable.

The binder serves a number of additionally important purposes in the constructions of the present invention. The imageable materials are protected from ambient conditions such as moisture. The consistency of the coating and its image quality are improved. The durability of the final image is also significantly improved. The binder should be present as at least about 25% by weight of ingredients in the layer, more preferably as 50% or 70% by weight and most preferably as at least about 80% by weight of dry ingredients (i.e., excluding solvents in the layer). A generally useful range is 30 to 98 percent by weight binder with 75 to 95 percent preferred.

Nitrate Salt

Nitrate salts themselves are well known. They may be supplied as various chemical compounds, but are desirably provided as a metal salt, and most preferably provided as a hydrated metal salt. Other ions which are ordinarily good oxidizing ions such as nitrite, chlorate, iodate, perchlorate, periodate, and persulfate do not provide comparable results. Extremely active oxidizing agents, such as iodate, even used in relatively smaller proportions to prevent complete and immediate oxidation or colorization of the dyes do not perform nearly as well as nitrate ion compositions. The performance of nitrate is so far superior to any other ion that it is apparently unique in the practice of the present invention.

Most means of supplying the nitrate salt into the composition are satisfactory, for example, organic salts, metal salts, acid salts, mixtures of acids and salts, and other means of supplying the ion are useful. For example, nitrates of zinc, cadmium, potassium, calcium, zirconyl ($ZrO_2$), nickel, aluminum, chrominum, iron, copper, magnesium, lithium, lead and cobalt, ammonium nitrate, cerous ammonium nitrate, and combinations of the above may be used.

The nitrate salt component of the present invention is desirably present in a form within the imaging layer so the oxidizing quantities of $HNO_3$, NO, $NO_2$, or $N_2O_4$ will be provided within the layer when it is heated to a temperature no greater than 200° C. for 60 seconds and preferably no greater than 160° C. for 60 or most preferably 30 seconds. This may be accomplished with many different types of salts, both organic and inorganic, and in variously different types of constructions.

The most convenient way of providing such thermal oxidant providing nitrate salts is to provide a hydrated nitrate salt such as magnesium nitrate hexahydrate ($Mg(NO_3)_2 \times 6H_2O$).

In addition to hydrated nitrate salts, non-hydrated salts such as ammonium nitrate, pyridinium nitrate, and guanidinium nitrate in an acidic environment are also capable of providing the oxidizing capability necessary for practice of the present invention.

Besides the inorganic type of salts generally described above, organic salts in non-alkaline environments are also quite useful in the practice of the present invention. In particular, nitrated quaternary ammonium salts such as guanidinium nitrate work quite well in acid environments, but will not provide any useful image in a basic environment.

It is believed that the alkaline environment causes any oxidizing agent (e.g., $HNO_3$, NO, $NO_2$, and/or $N_2O_4$) which is liberated from the nitrate salt to be neutralized so as to prevent oxidation of the leuco dyes. For this reason it is preferred to have an acidic environment for the nitrate salt. One other consideration should be given in the selection of the nitrate salt and that is the choice of a salt in which the cation is non-reactive with the dye. Non-reactive salts are defined in the practice of the present invention as those salts the cations of which do not spontaneously oxidize the dyes that they are associated with at room temperature. This may be determined in a number of fashions. For example, the dye and a non-nitrate (preferably halide) salt of the cation may be co-dissolved in a solution. If the salt oxidizes the dye spontaneously (within two minutes) at room temperature, it is a reactive salt. Such salts as silver nitrate, in which the cation itself is a strong oxidizing agent, is a reactive salt. Ceric nitrate is also reactive, while hydrated cerous nitrate is not.

Preferred salts are the hydrated metal salts such as nickel nitrate hexahydrate, magnesium nitrate hexahydrate, aluminum nitrate nonahydrate, ferric nitrate nonahydrate, cupric nitrate trihydrate, zinc nitrate hexahydrate, cadmium nitrate tetrahydrate, bismuth nitrate pentahydrate, thorium nitrate tetrahydrate, cobalt nitrate hexahydrate, gadolinium or lanthanum nitrate nonahydrate, mixtures of these hydrated nitrates and the like. Nonhydrated (e.g., lithium nitrate) or organic nitrates may be admixed therewith.

Organic nitrates are also quite useful in the practice of the present invention. These nitrates are usually in the form of quarternary nitrogen containing compounds such as guanidinium nitrate, pyridinium nitrate, and the like. It is preferred to have at least 0.10 moles of nitrate ion per mole of leuco dye. It is more preferred to have at least 0.30 or 0.50 moles of ion per mole of dye. The nitrate ordinarily constitutes from 0.05 to 10 percent by weight of the imaging layer, preferably 0.1 to 10 percent and most preferably 0.5 to 8 percent by weight.

Leuco Dyes

Leuco dyes are well known. These are colorless compounds which when subjected to an oxidation reaction form colored dyes. These leuco dyes are well described in the art (e.g., U.S. Pat. No. 3,974,147; Mees, C. E. K.; James, R. *The Theory of Photographic Process*, 3rd Ed.; MacMillan: New York,; pp 283–284, 390–391; and Kosar, J. *Light-Sensitive Systems*; John Wiley and Sons: New York, 1965; pp 370–380, 406. Only those leuco dyes which can be converted to colored dyes by oxidation are useful in the practice of the present invention. The preferred leuco dyes are the acylated leuco diazine, phenoxazine, and phenothiazine dyes examples of which are disclosed in U.S. Pat. Nos. 4,460,677, 4,647,525, and G.B. Pat. No. 1,271,289.

Acid or base sensitive dyes such as phenolphthalein and other indicator dyes are not useful in the present invention. Indicator dyes form only transient images and are too sensitive to changes in the environment.

The leuco dye should be present as at least about 0.3 percent by weight of the total weight of the light sensitive layer, preferably at least 1 percent by weight, and most preferably at least 2 percent to 10 percent or more (e.g., 15 percent) by weight of the dry weight of the imageable layer. About 10 mole percent of the nitrate/-leuco dye is minimally used, with 20 to 80 mole percent preferred and from 35 to 65 mole percent most preferred. Molar percentages of nitrate/dye in excess of 100% are definitely useful. The leuco dye ordinarily constitutes from 0.5 to 15 percent by weight of the imaging layer preferably 2 to 8 percent.

Acidic Materials

Acidic materials may be added to the light sensitive layer to increase its speed. The acids used in the present invention are acids as generally known to one skilled in the art. Organic acids are preferred, but inorganic acids (generally in relatively smaller concentrations) are also useful. Organic acids having carboxylic groups are most preferred. The acid should be present as at least about 0.1 percent by weight of the total weight of the light sensitive layer. More preferably it is present in amounts from 0.2 to 2.0 times the amount of nitrate ion. The acid may, for example, be present in a range of from 0.05 to 10 percent by weight, preferably from 0.1 to 7 percent, most preferably from 0.5 to 5 percent. Higher molecular weight acids are generally used at the higher concentrations and lower molecular weight acids used at the lower concentrations. Anhydrides such as phthalic anhydride, maleic anhydride, succinic anhydride, acetic anhydride, and the like may also be used.

In forming or coating imageable layers onto a substrate, temperatures should, of course, not be used during manufacture which would completely colorize the layer or decompose the photobleachable dye. Some colorization is tolerable, with the initial leuco dye concentrations chosen so as to allow for anticipated changes. It is preferred, however, that little or no leuco dye be oxidized during forming and coating so that more standardized layers can be formed. Depending on the anticipated development temperature, the coating or forming temperature can be varied. Therefore, if the anticipated development temperature were, for example, 220° F. (104° C.), the drying temperature would be 140° F. (60° C.). It would therefore not be likely for the layer to gain any of its optical density at the drying temperature in less than 6–7 minutes. A reasonable development temperature range is between 160° F. (71° C.) and 350° F. (177° C.) and a reasonable dwell time is between 3 seconds and 2 minutes, preferably at between 175° F. (79° C.) and 250° F. (121° C.) and for 5 to 60 seconds, with the longer times most likely associated with the lower development temperatures.

The imageable layers of the present invention must under some conditions allow reactive association amongst the active ingredients in order to enable imaging. That is, the individual ingredients may or may not be separated by impenetrable barriers (i.e., which cannot be dissolved, broken, or disrupted during use) within the layer. Generally the active ingredients are homogeneously mixed (e.g., a molecular mixture) within the layer. They may be individually maintained in heat softenable binders which are dispersed or mixed within the layer and which soften upon heating to allow migration of ingredients, but this would require a longer development time. The ingredients may be incorporated into a binder medium, fine particles of which may be subsequently dispersed in a second layer binder medium as described in U.S. Pat. No. 4,708,928.

The imageable layers of the present invention may contain various materials in combination with the essential ingredients of the present invention. For example, plasticizers, coating aids, antioxidants (e.g., ascorbic acid, hindered phenols, phenidone, etc.), in amounts that would prevent oxidation of the dyes when heated), surfactants, antistatic agents, waxes, ultraviolet radiation absorbers, mild oxidizing agents in addition to the nitrate, and brighteners may be used without adversely affecting the practice of the invention.

What the prior art has not taught, but this invention teaches, is that photobleachable, light sensitive dyes may be combined with a nitrate salt and a leuco dye, to provide a light sensitive thermally developable imaging system. Visible light sensitive systems are desirable for natural full color reproduction, which cannot be obtained with ultraviolet or blue sensitive photoinitiators.

Additionally, by removing the need for iodonium salt or organic halogen containing compounds the compositions of the present invention increase stability of the developed image by reducing printout.

In cases where photobleachable dyes are used which have observable absorption in the visible spectrum are used, residual dye stain is reduced in exposed regions after development. Upon a further blanket exposure residual dye stain in unexposed regions can be removed, and subsequently fixed by treatment with ammonia vapor, thereby improving contrast, color fidelity over the entire visible spectrum, and light fastness of the developed imaging system.

These and other aspects of the present invention such as the advantages over the prior art will be shown in the following examples.

EXAMPLES

All materials used in the following examples are commercially available from Aldrich Chemical (Milwaukee, Wis.), unless otherwise indicated. All new materials which were prepared in the following examples were analyzed by one or more of the following analytical techniques: infrared, ultraviolet, $^1H$ nuclear magnetic resonance, or mass spectroscopies. The following abbreviations are employed tetrahydrofuran (THF), methanol (MeOH), ethanol (EtOH), tris(trichloromethyl)-1,3,5-triazine (TTT), diphenyliodonium hexafluorophosphate ($Ph_2I$), melting point (mp), boiling point (bp).

The terms $D_{max}$ and $D_{min}$ refer to the maximum and minimum optical density, respectively, which is observed in the developed imaged layer. Optical densities were determined using a MacBeth TD504 densitometer (Kollmorgen Corp., Newburgh, N.Y.), using either a Status A red or green filter as appropriate. The benzoyl leuco of Basic Blue 3 was purchased from Ciba-Geigy (Ardsley, N.Y.) under the trade name Pergascript Turquoise TM.

EXAMPLE 1

The o-nitroarylidene dyes of the type shown in Table 1 are prepared according to the general procedures described in U.S. Pat. No. 3,988,154.

TABLE 1

| Dye | $\lambda_{max}$ (nm) |
|---|---|
| 1 | 520 (THF) |
| 2 | 461 (EtOH) |
| 3 | 474 ($CH_2Cl_2$) |
| 4 | 492 (THF) |
| 5 | 495 ($CH_2Cl_2$) |
| 6 | 570 ($CH_2Cl_2$) |
| 7 | 565 ($CH_2Cl_2$) |
| 8 | 541 ($CH_2Cl_2$) |
| 9 | 550 ($CH_2Cl_2$) |

EXAMPLE 2

The o-nitroarylidene dyes of the type shown in Table 2 are prepared according to the general procedure described in U.S. Pat. No. 4,271,263.

TABLE 2

| Dye | $\lambda_{max}$ (nm) |
|---|---|
| 10 | 499 (THF) |
| 11 | 453 ($CH_2Cl_2$) |
| 12 | 463 ($CH_2Cl_2$) |

EXAMPLE 3

Preparation of 2-(2-nitrobenzylidine)-1,3-diethyl-1,2-dihydroimidazo [4,5-b]quinoxaline 13: A solution of 2.06 g (5 mmol) of 2-methylene-1,3-diethyl-1,2-dihydroimidazo[4,5-b]quinoxalinium p-toluenesulfonate, 0.70 g (5 mmol) of o-fluoronitrobenzene, 1.30 g (10 mmol) of diisopropylethylamine in 20 ml of butyronitrile was heated to reflux for six days. The solvent was removed in vacuo and the crude solid was washed with two 25 ml portions of hexanes. The product was extracted into 25 ml portions of hot hexanes (200 ml total) to afford a brownish-orange solid, mp 160°-162° C.

EXAMPLE 4

Preparation of dye 14: dye 14 was prepared from 4-fluoro-5-nitrophenylsulfone (Aldrich) using the general procedure of U.S. Pat. No. 3,988,154 to afford a violet-brown solid, mp 264°-267° C.

EXAMPLE 5

Preparation of dye 15: dye 15 was prepared from 4-fluoro-5-nitrophenylsulfone (Aldrich) using the general procedure of U.S. Pat. No. 3,988,154 to afford a dark brown solid, mp 156°-159° C. A solution of 4 mg of dye 16 in 3 ml of THF photobleached 86% to colorless products after 5 min on a 3M Model 213 overhead projector.

EXAMPLE 6

This example demonstrates that the system containing o-nitroarylidene dye 1 provides effective photoimaging with visible light. A coating solution was prepared by mixing 10 mg of o-nitroarylidene dye 1, 80 mg of the benzoyl leuco of Basic Blue 3, 940 mg of a solution (prepared from 9 g MeOH, 0.26 g $Mg(NO_3)_2 \times 6H_2O$, and 0.14 g tartaric acid), and 7.5 g of 20% PKHH TM in THF. The solution was placed on a shaker table for 15 minutes at room temperature in a dark room. Under appropriate safelights, the solution was knife-coated upon 4 mil (0.1 mm) transparent polyethylene terephthalate film at 4 mil (0.1 mm) wet thickness, air dried for 15 minutes, and dried at 50° C. for 5 minutes. The development temperature of the dried film was determined by exposing lengthwise one-half of an 8"×2"(20.3 cm×5.1 cm) strip on a 3M brand "179" Contact Printer Processor containing a white tungsten light source for 20 seconds at the 32 exposure setting (about $8.5 \times 10^5$ microwatts/cm$^2$ as determined with a radiometric filter). The strip was placed on a Reichert Heizbank apparatus (from Kofler Reichert, Austria) for 20 seconds and the thermal limits (the temperature at which development occurred) were determined for the exposed ($T_{exp}$) and unexposed ($T_{unexp}$) regions. The cyan color developed at 72° C. and 85° C. respectively. Similar imagewise light exposure for 10 seconds through a template followed by thermal development at 90° C. for twenty seconds afforded a bright cyan transparency image as a negative of the original template and having a transmission optical density of $D_{max}=2.15$ and $D_{min}=0.09$ optical density units (as determined with a Status A red filter on a Macbeth TD504 densitometer). One-half of an imaged and processed 8"×2"(20.3 cm×5.1 cm) strip was exposed on a 3M brand Model 213 overhead projector for 5 minutes. The uv spectrum of the unexposed half was taken, the $\lambda_{max}$ of dye 1 was determined, and the optical density of the exposed half was measured at the $\lambda_{max}$. The reddish background stain due to dye 1 in the film was photobleached by 94% (i.e., the absorbance of the film at the $\lambda_{max}$ decreased by 94%) to an essentially colorless background.

EXAMPLE 7

This example demonstrates that the system with o-nitroarylidene dye 1 provides effective photoimaging with visible light and improved image stability compared to the prior art constructions with halogenated compounds. An 8"×2"(20.3 cm×5.1 cm) strip of the dried film from Example 6 was exposed lengthwise through a Stouffer $\sqrt{2}$, 21 step tablet (Stouffer Graphic Arts, South Bend, Ind.) on a 3M brand "179" Contact Printer Processor for 10 seconds at a 32 exposure setting. The strip was processed on a drum processor with a dwell time of 20 seconds at 90° C. This afforded a negative of the original with eight steps of cyan image with a transmission optical density greater than 1.0 and nine steps of cyan image of optical density of $D_{min}+0.6$ where the $D_{max}=2.0$ and $D_{min}=0.2$ optical density units (as determined with a Status A red filter on a Macbeth TD504 densitometer). A processed sample was exposed for two hours on a 3M brand Model 213 overhead projector. The $D_{min}$ increased less than 0.06 and the $D_{max}$ increased 0.05 optical density units.

A control film was prepared as described in Example 6 containing 60 mg of 2,4,6-tris(trichloromethyl)-1,3,5-triazine. An 8"×2"(20.3 cm×5.1 cm) strip of the dried film was exposed lengthwise through a Stouffer $\sqrt{2}$, 21 step tablet on a 3M brand "179" Contact Printer Processor for 10 seconds at the 32 exposure setting. The strip was processed on a drum processor with a dwell time of 20 seconds at 89° C. This afforded a negative of the original with eight steps of cyan image of optical density of $D_{min}+0.6$. A processed sample was exposed for two hours on a 3M brand Model 213 overhead projector. The $D_{min}$ increased 1.30 and the $D_{max}$ increased 0.50 optical density units (as determined with a Status A red filter on a Macbeth TD504 densitometer).

EXAMPLES 8-11

These examples demonstrate that the system containing o-nitroarylidene dye 1 alone provides improved image stability over prior art constructions with halogenated or iodonium compounds. The same formulation of Example 6, except that 60 mg of the optional component was added, was used to prepare other films in the same manner. An 8'×2"(20.3×5.1 cm) strip of each dried film was placed on a Reichert Heizbank apparatus for 20 seconds and exposed for thirty minutes on a 3M brand Model 213 overhead projector. The increase in the cyan color background, $D_{min}$, was determined with a Status A red filter on a Macbeth TD504 densitometer.

TABLE 3

| Example | Optional Component | $D_{min}$ |
|---|---|---|
| 8 | diphenyliodonium hexafluorophosphate | 0.51 |
| 9 | 2-methyl-4,6-bis(trichloromethyl)-1,3,5-triazine | 0.54 |
| 10 | 2,4,6-tris(trichloromethyl)-1,3,5-triazine | 0.54 |
| 11 | none | +0.12 |

EXAMPLE 12

This example demonstrates the thermal development process is time and temperature dependent and that a range of development times or temperatures may be achieved. The same formulation of Example 6 was used to prepare another film in the same manner. An 8"×2"(20.3×5.1 cm) strip of the dried film was exposed lengthwise through a Stouffer $\sqrt{2}$, 21 step tablet on a 3M brand "179" Contact Printer Processor for 10 seconds at the 32 exposure setting and thermally developed for the indicated times to afford similar $D_{min}$ levels. The development times and the corresponding development temperatures required are shown in Table 4.

TABLE 4

| Development Time (sec) | Development Temperature (°C.) |
|---|---|
| 20 | 89 |
| 15 | 91 |
| 10 | 95 |
| 5 | 102 |

EXAMPLES 13-18

These examples illustrate other negative-acting imaging systems. Coating solutions containing the indicated amount of o-nitroarylidene dye, 80 mg of the benzoyl leuco of Basic Blue 3, 940 mg of a solution (prepared from 9 g MeOH, 0.26 g $Mg(NO_3)_2 \times 6H_2O$, and 0.14 g succinic acid), and 7.5 g of 20% PKHH TM in THF were used to prepare films in the same manner as described in Example 6. The development temperature of each dried film was determined by exposing lengthwise one-half of an 8"×2"(20.3×5.1 cm) strip on a 3M brand "179" Contact Printer Processor for 20 seconds at the full exposure setting (approximately $2.4 \times 10^6$ microwatts/cm$^2$). Each strip was placed on a Reichert Heizbank apparatus for 20 seconds and the thermal limits were determined for the exposed ($T_{exp}$) and unexposed ($T_{unexp}$) regions. The sensitivity of each dried negative acting film was determined by exposing one-half of an 8"×2"(20.3×5.1 cm) strip lengthwise through a Stouffer $\sqrt{2}$, 21 step tablet on a 3M brand "179" Contact Printer Processor for 10 seconds at the full exposure setting. Each strip was processed on a drum processor with a dwell time of 20 seconds at a temperature at which the $D_{min}$ level appeared. The speed of each strip (in number of steps) was determined at the point where the transmission optical density is $D_{min}+0.6$ optical density units (as determined with a Status A red filter on a Macbeth TD504 densitometer). The amount of photobleaching of each film was determined as described in Example 6. The results of each film are shown in Table 5, and show the general utility for the various o-nitroarylidene dyes.

TABLE 5

| Example | Dye | Amount (mg) | $\lambda_{max}$ (nm) | $T_{unexp}$ (°C.) | $T_{exp}$ (°C.) | Steps | % Photobleach |
|---|---|---|---|---|---|---|---|
| 13 | 2 | 16 | 471 | 100 | 90 | 5 | 78 |
| 14 | 3 | 12 | 474 | 95 | 80 | 6 | 80 |
| 15 | 4 | 12 | 507 | 103 | 95 | 2 | 75 |
| 16 | 13 | 15 | 450 | 87 | 76 | 9 | 75 |
| 17 | 14 | 10 | 505 | 85 | 74 | 7 | 97 |
| 18 | 15 | 10 | 475 | 87 | 78 | 5 | 94 |

EXAMPLES 19-26

These examples illustrate positive-acting imaging systems. Films were prepared and evaluated in the same manner as described in Examples 13-18 except that the speed of each positive acting strip (in number of steps) was determined at the point where the density is $D_{max}-0.6$ optical density units. The results of each film are shown in Table 6. Again, the results show the general utility for the o-nitroarylidene dyes. Some are clearly more effective than others and both positive and negative images may be produced. It is important to note that the phenomena by which imaging occurs is not understood.

TABLE 6

| Example | Dye | Amount (mg) | $\lambda_{max}$ (nm) | $T_{unexp}$ (°C.) | $T_{exp}$ (°C.) | Steps | % Photobleach |
|---|---|---|---|---|---|---|---|
| 19 | 5 | 12 | 495 | 95 | 110 | 5 | 99 |
| 20 | 6 | 16 | 570 | 130 | 145 | 8 | 92 |
| 21 | 7 | 6 | 565 | 118 | 135 | 8 | 94 |
| 22 | 8 | 20 | 541 | 95 | 105 | 5 | 40 |
| 23 | 9 | 21 | 550 | 95 | 102 | 4 | 38 |
| 24 | 10 | 9 | 499 | 102 | 112 | 5 | 66 |
| 25 | 11 | 7 | 453 | 95 | 102 | 6 | 45 |
| 26 | 12 | 11 | 463 | 92 | 102 | 7 | 79 |

EXAMPLES 27-28

A test analogous to the sensitizing dye test specified in U.S. Pat. Nos. 4,386,154 and 4,460,677 was performed. A standard test solution was prepared with the following composition:

5.0 g of 5% (weight by volume) solution in methyl ethyl ketone of polyvinyl butyral (45,000-55,000 molecular weight, 9.0-13.0% hydroxyl content "Butvar-B76" is a trademarked product of Monsanto Chem. Co.)

0.3 g of trimethylolpropane trimethacrylate 0.03 g of 2-methyl-4,6-bis(trichloromethyl)-1,3,5-triazine.

To this solution was added 0.02 g of the indicated dye. The solution was knife coated onto a 2 mil (0.05 mm) transparent polyethylene terephthalate film using a knife orifice of 2 mil (0.05 mm), and the coating was air dried for 30 minutes. Another 2 mil (0.05 mm) transparent polyethylene terephthalate film was carefully placed over the dried but soft and tacky coating with minimum entrapment of air. The sandwiched construction was then exposed for 15 seconds to a 3M Model 70 light source (650 Watt tungsten lamp) through a template with clear and opaque areas. This procedure essentially photobleached the dyes in Examples 27 and 28 in the light exposed areas. After exposure the cover film was removed, and the coating was treated with a finely divided black toner powder of the type conventionally used in xerography. If the tested material was a sensitizer as described in U.S. Pat. No. 4,386,154, the trimethylol propane trimethacrylate monomer in the light exposed areas would be polymerized by the light generated free radicals from the photolyzable organic halogen compound, (i.e., 2-methyl-4,6-bis(trichloromethyl)-1,3,5-triazine). Since the polymerized areas are essentially tack free, the black toner powder will selectively adhere only to the tacky, unexposed areas of the coating, providing a visual image corresponding to that in the template. The results are shown in Table 7 are compared with a sensitizing dye (5,10-diethoxy-16,17-dimethoxyviolanthrene) of the prior art. These examples demonstrate the present invention is outside the scope of the prior art as described in U.S. Pat. Nos. 4,386,154 and 4,460,677.

TABLE 7

| Example | Dye | Tonor Image |
|---|---|---|
| 27 | 1 | No |
| 28 | 2 | No |
| Control | 5,10-diethoxy-16,17-dimethoxyviol-anthrene | Yes |

EXAMPLE 29

This example illustrates the process of preparing a clear transparent image. A coating solution containing 20 mg of o-nitroarylidene dye 1, 160 mg of the benzoyl leuco of Basic Blue 3, 1.88 g of a solution (prepared from 27 g MeOH, 0.78 g $Mg(NO_3)_2 \times 6H_2O$, and 0.42 g succinic acid), and 15 g of 20% PKHH TM in THF was used to prepare a film in the same manner as described in Example 6. The dried film was exposed on a 3M brand "179" Contact Printer Processor for 20 seconds at a 64 exposure setting through a color negative and thermally developed on a drum processor with a dwell time of 20 seconds at 82° C. This afforded a bright cyan transparency image as a negative of the original with a red background. The image was exposed on a 3M brand Model 213 overhead projector for 2–5 minutes. The final image was devoid of the red background.

EXAMPLE 30

This example illustrates the ability to increase sensitivity with increasing exposure temperature. The same formulation of Example 6, except that the acid solution contained 0.14 g succinic acid in place of tartaric acid, was used to prepare another film in the same manner. The dried film was stored for two weeks at room temperature in a black bag. The dried film was exposed on a hot plate through a Stouffer $\sqrt{2}$, 21 step tablet with a 150 Watt tungsten reflector spot at 30 inches from the film. The film was thermally developed on a drum processor with a dwell time of 25 seconds at 95° C. This afforded a bright cyan transparency image as a negative of the original. The table indicates the number of steps of cyan color developed at a transmission optical density of $D_{min}+0.6$ (as determined with a Status A red filter on a Macbeth TD504 densitometer), the number of steps of cyan color with transmission optical density equal to or greater than 1.0 optical density units, and $D_{max}$ versus the exposure temperature.

TABLE 8

| Exposure Temperature (°C.) | Steps ($D_{min}$ + 0.6) | Steps (O.D. > 1.0) | $D_{max}$ |
|---|---|---|---|
| 25 | 10 | 9 | 2.5 |
| 60 | 12 | 11 | 2.8 |
| 90 | 14 | 13 | 2.7 |

EXAMPLE 31

The formulation of Example 30 was used to prepare another film in the same manner. The dried film was exposed at room temperature through a calibrated Stouffer $\sqrt{2}$, 21 step tablet in a sensitometer with a calibrated visible light of 536 nm with a band width of 20 nm. The film was thermally developed on a drum processor with a dwell time of 25 seconds at 91° C. The film required light energy of 2000 ergs/cm$^2$ to generate a transmission optical density of $D_{min}+0.6$ and 2600 ergs/cm$^2$ to afford an optical density of 1.0 (as determined with a Status A red filter on a Macbeth TD504 densitometer).

EXAMPLE 32

The formulation of Example 30 was used to prepare a film on 4 mil (0.1 mm) filled opaque polyethylene terephthalate in the same manner. The dried film was exposed on a 3M brand "179" Contact Printer Processor for 5 seconds at the 32 exposure setting through a Stouffer $\sqrt{2}$, 21 step tablet and thermally developed on a drum processor with a dwell time of 25 seconds at 91° C. The image was exposed on a 3M brand Model 213 overhead projector for 5 minutes. This afforded a bright cyan image as a reflection print without red background stain with a $D_{max}$ reflection optical density greater than 3.0 optical density units (as determined with a Status A red filter on a Macbeth TR527 densitometer). In addition, 9 steps of cyan color with reflection optical density >1.0 were generated.

EXAMPLE 33

The formulation of Example 30 was used to prepare another film in the same manner. 8"×2"(20.3×5.1 cm) strips of the dried film were exposed lengthwise on a 3M brand "179" Contact Printer Processor for 10 seconds at the 32 exposure setting and stored in the dark for the indicated time period. Each strip was placed on a Reichert Heizbank apparatus for 20 seconds. Table 9 reveals the time period between exposure and thermal development and the image temperature differentials (ΔT° C.) between the exposed and unexposed portions.

TABLE 9

| Time | Temperature (°C.) |
|---|---|
| 1 min | 10 |
| 1 hr | 6 |
| 1 day | 3 |
| 5 days | 1 |

EXAMPLE 34

A coating solution containing 20 mg of o-nitroarylidene dye 2, 80 mg of the benzoyl leuco of Basic Blue 3, 0.94 g of a solution (prepared from 27 g MeOH, 0.78 g $Mg(NO_3)_2 \times 6H_2O$, and 0.42 g succinic acid), and 7.5 g of 20% PKHH TM in THF was used to prepare a film in the same manner as in Example 6. The dried film was exposed through a Stouffer 21 step tablet on 3M brand "179" Contact Printer Processor for 10 seconds at the 32 exposure setting. The film was thermally developed on a drum processor with a dwell time of 20 seconds at 88° C. This afforded a bright cyan transparency image as a negative of the original having a transmission optical density $D_{max}$ of 2.8 optical density units (as determined with a Status A red filter on a Macbeth TD504 densitometer), $D_{min}$ of 0.12 optical density units, and 6 steps with image optical density greater than or equal to 1.0 optical density units.

EXAMPLE 35

A coating solution containing 10 mg of o-nitroarylidene dye 1, 120 mg of the diazine magenta leuco 23, 0.94 g of a solution (prepared from 27 g MeOH, 0.78 g $Mg(NO_3)_2 \times 6H_2O$, and 0.42 g succinic acid), and 7.5 g of 20% PKHH TM in THF was used to prepare a film in the same manner as Example 6. The dried film was exposed through a Stouffer $\sqrt{2}$, 21 step tablet on 3M brand "179" Contact Printer Processor for 10 seconds at the 32 exposure setting. The film was thermally developed on a drum processor with a dwell time of 20 seconds at 80° C. and exposed on a 3M brand Model 213 overhead projector for 5 minutes. This afforded a bright magenta transparency image as a negative of the original having transmission optical density $D_{max}$ of 1.70 optical density units (Status A green filter), $D_{min}$ of 0.22 optical density units, and 5 steps with image optical density greater than or equal to 1.0 optical density units.

EXAMPLE 36

A coating solution containing 10 mg of o-nitroarylidene dye 1, 60 mg of 2,4,6-tris(trichloromethyl)-1,3,5-triazine, 120 mg of the diazine magenta leuco 23, 0.94 g of a solution (prepared from 27 g MeOH, 0.78 g $Mg(NO_3)_2 \times 6H_2O$, and 0.42 g succinic acid), and 7.5 g of 20% PKHH TM in THF was used to prepare a film in the same manner as Example 6. The dried film was exposed through a Stouffer $\sqrt{2}$, 21 step tablet on 3M brand "179" Contact Printer Processor for 10 seconds at the 32 exposure setting. The film was thermally developed on a drum processor with a dwell time of 20 seconds at 78.5° C. The sample was exposed on a 3M brand Model 213 overhead projector for 5 minutes. This afforded a bright magenta transparency image as a negative of the original having transmission optical density $D_{max}$ of 2.10 optical density units (Status A green filter), and $D_{min}$ of 0.12 optical density units.

This sample and a sample from Example 35 with transmission optical density $D_{max}$ Of 2.0 and $D_{min}$ of 0.07 optical density units were exposed on a 3M brand Model 213 overhead projector for 30 minutes. The increases in $D_{max}$ and $D_{min}$ are shown in Table 10.

TABLE 10

| Example | $D_{max}$ | $D_{min}$ |
|---|---|---|
| 35 | 0.00 | 0.12 |
| 36 | 1.04 | 1.90 |

EXAMPLES 37–42

These examples indicate the wide variety of the different leuco dyes which can be used in the construction. All constructions were identical to Example 6 except that different leuco dyes were used in place of the leuco dye of Example 6. The development temperatures of the dried films were determined by exposing lengthwise one-half of an 8"×2"(20.3×5.1 cm) strip on a 3M brand "179" Contact Printer Processor for 20 seconds at the 32 exposure setting. The strips were placed on a Reichert Heizbank apparatus for 20 seconds and the development temperatures were determined. An 8"×2"(20.3×5.1 cm) strip of each film was exposed lengthwise through a Stouffer $\sqrt{2}$, 21 step tablet on a 3M brand "179" Contact Printer Processor for 10 seconds at the 32 exposure setting and thermally developed on a drum processor for 20 seconds at the appropriate development temperature. The samples were exposed on a 3M brand Model 213 overhead projector for 5 minutes to remove the red stain from o-nitroarylidene dye 1. The approximate development temperature, average $D_{min}$ average $D_{max}$, and the average number of steps of transmission optical density of $D_{min}+0.6$ of the examples are shown in Table 11. A Status A red filter was used for the densitometer readings of the blue and cyan thiazine and oxazine samples. A Status A green filter was used for readings of magenta diazine samples.

TABLE 11

| Example | Dye | Development Temperature (°C.) | $D_{min}$ | $D_{max}$ | Steps |
|---|---|---|---|---|---|
| 37 | 24 | 90 | 0.27 | 1.90 | 10.5 |
| 38 | 25 | 92 | 0.27 | 1.72 | 12.2 |
| 39 | 26 | 97 | 0.21 | 2.05 | 6.8 |
| 40 | 27 | 92 | 0.29 | 2.36 | 7.6 |
| 41 | 28 | 73 | 0.23 | 2.10 | 8.5 |
| 42 | 29 | 95 | 0.25 | 2.15 | 11.7 |

EXAMPLE 43

A coating solution containing 10 mg of o-nitroarylidene dye 1, 80 mg of the benzoyl leuco of methylene blue thiazine, 0.94 g of a solution (prepared from 9 g MeOH, 0.26 g $Mg(NO_3)_2 \times 6H_2O$, and 0.16 g 1,3,5-benzenetricarboxylic acid), and 7.5 g of 20% PKHH TM in THF was used to prepare a film in the same manner as Example 6. The dried film was exposed through a Stouffer $\sqrt{2}$, 21 step tablet on 3M brand "179" Contact Printer Processor for 10 seconds at the 32 exposure setting. The film was thermally developed on a drum processor with a dwell time of 20 seconds at 89° C. The sample was exposed on a 3M brand Model 213 overhead projector for 5 minutes. This afforded a bright blue transparency image devoid of red background stain as a negative of the original having transmission optical density $D_{max}$ of 1.76 optical density units (Status A red filter), and $D_{min}$ of 0.09 optical density units, and six steps of optical density greater than 1.0.

EXAMPLE 44

This example illustrates the ability to use more than one leuco dye in the imaging system. A coating solution containing 5 mg of o-nitroarylidene dye 1, 40 mg of the benzoyl leuco of Basic Blue 3, 58 mg of diazine magenta leuco 23, 470 mg of a solution (prepared from 9 g MeOH, 0.26 g $Mg(NO_3)_2 \times 6H_2O$, and 0.14 g tartaric acid), and 7.5 g of 20% PKHH TM in THF was used to prepare a film in the same manner as Example 6. The development temperature of the dried film was determined by exposing lengthwise one-half of an 8"×2" (20.3×5.1 cm) strip on a 3M brand "179" Contact Printer Processor for 20 seconds at the 32 exposure setting. The strip was placed on a Reichert Heizbank apparatus for 20 seconds and the development temperatures were determined. A mixed purple color from the development of both leuco dyes was generated and developed at 102° C. on the unexposed portion and at 88° C. on the exposed portion.

EXAMPLES 45–48

These examples show the wide variety of nitrate salts which can be used in the construction. The same formulation of Example 6, except that 0.94 g of a solution (prepared from 9 g methanol, 0.14 g succinic acid, and the indicated amount of nitrate salt), was used to prepare films in the same manner. The development temperature of each dried film was determined by exposing lengthwise one-half of an 8"×2" (20.3×5.1 cm) strip on a 3M brand "179" Contact Printer Processor for 20 seconds at the 32 exposure setting. Each strip was placed on a Reichert Heizbank apparatus for 20 seconds and the thermal limits were determined for the exposed ($T_{exp}$) and unexposed ($T_{unexp}$) regions. The sensitivity of each negative acting film was determined by exposing one-half of an 8"×2" (20.3×5.1 cm) strip lengthwise through a Stouffer $\sqrt{2}$, 21 step tablet on a 3M brand "179" Contact Printer Processor for 10 seconds at the 32 exposure setting. Each strip was processed on a drum processor with a dwell time of 20 seconds at a temperature at which the $D_{min}$ level appeared. This afforded bright cyan transparency images as negatives of the original. The speed of each strip (in number of steps) was determined at the point where the transmission optical density is $D_{min}+0.6$ optical density units. The development temperature, $D_{min}$, $D_{max}$, and the number of steps of image optical density of $D_{min}+0.6$ of the example are shown in Table 12. A Status A red filter was used for the densitometer readings. The addition of silver nitrate to the formulation resulted in undesired oxidation of the coating formulation within one minute. This unacceptable film possessed a very high background $D_{min}$ when dried at room temperature. Therefore, silver nitrate is not a useful oxidant of the present invention.

TABLE 12

| Example | Metal Nitrate | $T_{unexp}$ (°C.) | $T_{exp}$ (°C.) | Development Temp. (°C.) | $D_{min}$ | $D_{max}$ | Steps |
|---|---|---|---|---|---|---|---|
| 45 | 0.29 g $Ni(NO_3)_2$ x$6H_2O$ | 86 | 74 | 87 | 0.16 | 2.74 | 7.8 |
| 46 | 0.30 g $Zn(NO_3)_2$ x$6H_2O$ | 88 | 76 | 88 | 0.15 | 2.95 | 8.4 |
| 47 | 0.14 g $LiNO_3$ | 94 | 83 | 95 | 0.14 | 2.56 | 9.0 |
| 48 | 0.34 g $AgNO_3$ | — | — | — | — | — | — |

EXAMPLES 49–52

These examples demonstrate that acidic materials are desirable in the constructions. Coating solutions containing 10 mg of o-nitroarylidene dye 1, 120 mg of magenta diazine leuco 23, 940 mg of a solution (prepared from 9 g MeOH, the indicated amount of acid, and the indicated amount of nitrate salt), and 7.5 g of 20% PKHH TM in THF were used to prepare films in the same manner as described in Example 6. The development temperature of each dried film was determined by exposing lengthwise one-half of an 8"×2" (20.3×5.1 cm) strip on a 3M brand "179" Contact Printer Processor for 20 seconds at the 32 exposure setting. Each strip was placed on a Reichert Heizbank apparatus for 20 seconds and the thermal limits were determined for the exposed ($T_{exp}$) and unexposed ($T_{unexp}$) regions. The sensitivity of each negative acting film was determined by exposing one-half of an 8"×2" (20.3×5.1 cm) strip lengthwise through a Stouffer $\sqrt{2}$, 21 step tablet on a 3M brand "179" Contact Printer Processor for 10 seconds at the 32 exposure setting. Each strip was processed on a drum processor with a dwell time of 20 seconds at a temperature at which the $D_{min}$ level appeared. This afforded bright magenta transparency images as negatives of the original. The speed of each strip (in number of steps) was determined at the point where the transmission optical density is $D_{min}+0.6$. The development temperature, $D_{min}$, $D_{max}$, and the number of steps of image optical density of $D_{min}+0.6$ of the examples are shown in Table 13. A Status A green filter was used for the densitometer readings.

TABLE 13

| Example | Metal Nitrate | Acid | $T_{unexp}$ (°C.) | $T_{exp}$ (°C.) |
|---|---|---|---|---|
| 49 | 0.16 g $NH_4NO_3$ | 0.14 g succinic | 143 | 160* |
| 50 | 0.26 g $Mg(NO_3)_2$ x$6H_2O$ | 0.27 g salicylic | 92 | 78 |
| 51 | 0.30 g $Mg(NO_3)_2$ x$6H_2O$ | none | 119 | 109 |
| 52 | 0.24 g $Al(NO_3)_2$ x$6H_2O$ | none | 79 | 72 |

*positive image

EXAMPLES 53–55

These examples show that other binders may be useful in the invention. Coating solutions containing 10 mg of o-nitroarylidene dye 1, 80 mg of the benzoyl leuco of Basic Blue 3, 940 mg of a solution (prepared from 9 g MeOH, 0.14 g succinic acid, and 0.26 g of $Mg(NO_3)_2$×$6H_2O$) and the amount of the indicated binder in THF or in methyl ethyl ketone for Saran F-310 TM were used to prepare films in the same manner as in Example 6. The development temperature of each dried film was determined by exposing lengthwise one-half of 8"×2" (20.3×5.1 cm) strip on a 3M brand "179" Contact Printer Processor for 20 seconds at the 32 exposure setting. Each strip was placed on a Reichert Heizbank apparatus for 20 seconds and the thermal limits were determined for the exposed ($T_{exp}$) and unexposed ($T_{unexp}$) regions. The sensitivity of each negative acting film was determined by exposing one-half of an 8"×2" (20.3×5.1 cm) strip lengthwise through a Stouffer $\sqrt{2}$, 21 step tablet on a 3M brand "179" Contact Printer Processor for 10 seconds at the 32 exposure setting. Each strip was processed on a drum processor with a dwell time of 20 seconds at a temperature at which the $D_{min}$ level appeared. This afforded bright cyan transparency images as negatives of the original. The speed of each strip (in number of steps) was determined at the point where the transmission optical density is $D_{min}+0.6$ optical density units. The development temperature, $D_{min}$, $D_{max}$, and the number of steps of image optical density of $D_{min}+0.6$ of the example are shown in Table 14. A Status A red filter was used for the densitometer readings.

TABLE 14

| Example | Binder + THF | $T_{unexp}$ (°C.) | $T_{exp}$ (°C.) | Development Temp. (°C.) | $D_{min}$ | $D_{max}$ | Steps |
|---|---|---|---|---|---|---|---|
| 53 | 0.75 g Saran F-310 + 6.75 g THF | 81 | 71 | 85 | 0.10 | 2.66 | 5.8 |
| 54 | 0.75 g | 78 | 74 | 82 | 0.33 | 1.08 | * |

TABLE 14-continued

| Example | Binder + THF | $T_{unexp}$ (°C.) | $T_{exp}$ (°C.) | Development Temp. (°C.) | $D_{min}$ | $D_{max}$ | Steps |
|---|---|---|---|---|---|---|---|
| | cellulose acetate butyrate + 6.75 g THF | | | | | | |
| 55 | 0.68 g Formvar 15/95E + 6.82 g THF | 87 | 76 | 89 | 0.12 | 2.45 | 7.9 |

* not measured

EXAMPLES 56–57

Coating solutions containing 10 mg of indicated o-nitroarylidene dye, 80 mg of the benzoyl leuco of Basic Blue 3, 470 mg of a solution (prepared from 27 g MeOH and 0.78 g $Mg(NO_3)_2 \times 6H_2O$, and 0.42 g succinic acid), and 7.5 g of 20% PKHH TM in THF were used to prepare films in the same manner as Example 6. The development temperature of each dried film was determined by exposing lengthwise one-half of an 8"×2" (20.3×5.1 cm) strip on a 3M brand "179" Contact Printer Processor for 20 seconds at the full exposure setting. Each strip was placed on a Reichert Heizbank apparatus for 20 seconds and the thermal limits were determined for the exposed ($T_{exp}$) and unexposed ($T_{unexp}$) regions. The positive images were placed on a 3M brand Model 213 overhead projector for 5 minutes. The results are shown in Table 15.

TABLE 15

| Example | Dye | $T_{unexp}$ (°C.) | $T_{exp}$ (°C.) | Image Color |
|---|---|---|---|---|
| 56 | 5 | 90 | 97 | cyan |
| 57 | 12 | 91 | 101 | cyan |

EXAMPLES 58–59

Coating solutions containing 10 mg of indicated o-nitroarylidene dye, 80 mg of the benzoyl leuco of methylene blue, 470 mg of a solution (prepared from 27 g MeOH and 0.78 g $Mg(NO_3)_2 \times 6H_2O$, and 0.42 g succinic acid), and 7.5 g of 20% PKHH TM in THF were used to prepare films in the same manner as Example 6. The development temperature of each dried film was determined by exposing lengthwise one-half of an 8"×2" (20.3×5.1 cm) strip on a 3M brand "179" Contact Printer Processor for 20 seconds at the full exposure setting. Each strip was placed on a Reichert Heizbank apparatus for 20 seconds and the thermal limits were determined for the exposed ($T_{exp}$) and unexposed ($T_{unexp}$) regions. The positive images were placed on a 3M brand Model 213 overhead projector for 5 minutes. The results are shown in Table 16.

TABLE 16

| Example | Dye | $T_{unexp}$ (°C.) | $T_{exp}$ (°C.) | Image Color |
|---|---|---|---|---|
| 58 | 5 | 95 | 105 | blue |
| 59 | 12 | 90 | 106 | blue |

EXAMPLES 60–61

Coating solutions containing 10 mg of indicated o-nitroarylidene dye, 80 mg of the diazine magenta leuco 23, 470 mg of a solution (prepared from 27 g MeOH and 0.78 g $Mg(NO_3)_2 \times 6H_2O$, and 0.42 g succinic acid), and 7.5 g of 20% PKHH TM in THF were used to prepare films in the same fashion as Example 6. The development temperature of each dried film was determined by exposing lengthwise one-half of an 8"×2" (20.3×5.1 cm) strip on a 3M brand "179" Contact Printer Processor for 20 seconds at the full exposure setting. Each strip was placed on a Reichert Heizbank apparatus for 20 seconds and the thermal limits were determined for the exposed ($T_{exp}$) and unexposed ($T_{unexp}$) regions. The positive images were placed on a 3M brand Model 213 overhead projector for 5 minutes. The results are shown in Table 17.

TABLE 17

| Example | Dye | $T_{unexp}$ (°C.) | $T_{exp}$ (°C.) | Image Color |
|---|---|---|---|---|
| 60 | 5 | 82 | 84 | magenta |
| 61 | 12 | 82 | 87 | magenta |

EXAMPLES 62–63

Coating solutions containing 10 mg of indicated o-nitroarylidene dye, 80 mg of the leuco 30, 470 mg of a solution (prepared from 27 g MeOH and 0.78 g $Mg(NO_3)_2 \times 6H_2O$, and 0.42 g succinic acid), and 7.5 g of 20% PKHH TM in THF were used to prepare films in the same manner as Example 6. The development temperature of each dried film was determined by exposing lengthwise one-half of an 8"×2" (20.3×5.1 cm) strip on a 3M brand "179" Contact Printer Processor for 20 seconds at the full exposure setting. Each strip was placed on a Reichert Heizbank apparatus for 20 seconds and the thermal limits were determined for the exposed ($T_{exp}$) and unexposed ($T_{unexp}$) regions. The positive images were placed on a 3M brand Model 213 overhead projector for 5 minutes. The results are shown in Table 18.

TABLE 18

| Example | Dye | $T_{unexp}$ (°C.) | $T_{exp}$ (°C.) | Image Color |
|---|---|---|---|---|
| 62 | 5 | 75 | 78 | orange |
| 63 | 12 | 72 | 77 | orange |

EXAMPLES 64–70

These examples illustrate arylidene dyes containing aryl groups other than the o-nitrophenyl moiety which afford negative-acting imaging systems. Coating solutions containing the indicated amount of o-nitroarylidene dye, 80 mg of the benzoyl leuco of Basic Blue 3, 940 mg of a solution (prepared from 9 g MeOH, 0.26 g $Mg(NO_3)_2 \times 6H_2O$, and 0.14 g succinic acid), and 7.5 g of 20% PKHH TM in THF were used to prepare films in the same manner as Example 6. The development temperature of each dried film was determined by exposing lengthwise one-half of an 8"×2" (20.3×5.1 cm) strip on a 3M brand "179" Contact Printer Processor for 20 seconds at the full exposure setting. Each strip was placed on a Reichert Heizbank apparatus for 20 seconds and the thermal limits were determined for the exposed ($T_{exp}$) and unexposed ($T_{unexp}$) regions. The results of each film are shown in Table 19.

TABLE 19

| Example | Dye | Amount (mg) | $\lambda_{max}$ (nm) | $T_{unexp}$ (°C.) | $T_{exp}$ (°C.) |
|---|---|---|---|---|---|
| 64 | 16 | 10 | 450 | 101 | 95 |
| 65 | 17 | 10 | 536 | 95 | 90 |
| 66 | 18 | 10 | 580 | 90 | 88 |
| 67 | 19 | 25 | 566 | 110 | 100 |
| 68 | 20 | 15 | 623 | 110 | 100 |
| 69 | 21 | 20 | 750 | 110 | 102 |
| 70 | 22 | 18 | 696 | 110 | 98 |

EXAMPLE 71

This example illustrates that exposure to ammonia vapor thermally stabilizes the imageable layers of the present invention.

A solution was prepared from 7.50 g 20% PKHH TM in THF, 0.12 g magenta leuco 23, 0.01 g of 1, and 0.94 g of a solution (9 g MeOH, 0.26 g magnesium nitrate hexahydrate, and 0.14 g tartaric acid).

The solution was knife coated onto 4 mil transparent polyester (PET) substrate at 4 mil wet thickness, dried at room temperature for 15 minutes, and dried at 50° C. for 5 minutes. The film was cut into strips which were placed on a Reichert Heizbank thermal gradient apparatus for 20 seconds, and the thermally developed strips were placed in a chamber containing ammonia vapor from concentrated ammonium hydroxide at room temperature. Exposure times were 0, 0.5, 1, 5, 10, and 15 minutes.

The strips were then exposed on a 3M brand Model 213 overhead projector, and using a MacBeth TR527 densitometer (Status A red filter), the optical density increase of the background area $D_{min}$ was determined as a function of time at a temperature 5° C. lower than that at which the dye thermally developed. Color formation in the background areas (printout) was reduced with increased exposure to ammonia vapor. The greatest reduction of printout occurred with ammonia exposures of 1 to 5 minutes.

A control experiment in which water vapor was substituted for the ammonia vapor showed no dependence of printout rate with vapor contact time.

EXAMPLE 72

Nitrone dyes 24 and 25 were prepared by the condensation o-phenylhydroxylamine with the corresponding aldehyde (3,3-(4'-dimethylaminophenyl)propenal or 3-(4'dimethylaminophenyl)propenal for 24 and 25, respectively, in EtOH according to the methods of West, P. R.; Davis, G. C.; Griffing, B. F. *J. Imag. Sci.* 1986, 30, 65. Compound 24 was recrystallized from EtOH, mp 243–9 (dependent on heating rate), $\lambda_{max}$=428 nm. Compound 25 was recrystallized from toluene, mp 247–9, $\lambda_{max}$=417 nm. Under extended irradiation in THF solution 24 and 25 give 98% and 100% photobleaching to colorless products, respectively.

EXAMPLES 73–74

This example demonstrates that o-nitroarylidene dye 1 serves to activate nitrate mediated oxidation following exposure to light.

Solution A was prepared by mixing 26.25 g of 20% PKHH TM in tetrahydrofuran, 0.28 g of the benzoyl leuco of Basic blue 3, and 0.04 g of dye 1. Solution B was prepared by mixing 26.25 g of 20% PKHH TM in tetrahydrofuran, and 0.28 g of the benzoyl leuco of Basic Blue 3. Solution C was prepared by mixing 9 g methanol, 0.26 g of $Mg(NO_3)_2 \times 6H_2O$, and 0.14 g of succinic acid.

Two coating solutions were prepared (Solutions D and E), by mixing 7.5 g of Solution A or Solution B, and 0.94 g of Solution C, respectively. Coatings were prepared according to procedure of Example 6.

Strips of 20.3 cm×5.1 cm (8"×2") were placed on a Reichert Heizbank thermal gradient apparatus for 20 seconds and thermal limit readings (i.e., the lower temperature limit at which dye development occurs) was determined as an average of duplicate samples. The results are presented in Table 20.

TABLE 20

| Example | Solution | Thermal Limit (°C.) |
|---|---|---|
| 73 | D | 94 |
| 74 | E | 95 |

Strips of the film coated with Solution D were imagewise exposed for 10 seconds on a 3M brand Model 179 contact printer processor at the 32 exposure setting. The thermal limit of the exposed samples was measured as before to give an average value of 86° C.

EXAMPLE 75

This example demonstrates that a fixed image with reduced background dye stain, improved color, and improved thermal stability can be prepared by the steps of (1) imagewise exposure, (2) thermal development, (3) blanket exposure, and (4) fixing by exposure to ammonia vapor.

The film construction of Example 74 was imagewise exposed as in Examples 74–75, and then thermally processed for 20 seconds at 85° C. to afford a blue-cyan colored negative image of the original image with magenta stain throughout exposed and unexposed regions. Transmission densitometer readings (Status A green filter, indicative of magenta color, and Status A filter, indicative of cyan color), were measured for both $D_{max}$ (light exposed), and $D_{min}$ (unexposed) areas on a MacBeth TR527 densitometer.

The imaged and thermally processed samples were blanket exposed for 1 minute on a 3M brand Model 213 overhead projector resulting in bright cyan images with much lower background stain. $D_{min}$ and $D_{max}$ readings were again recorded. The results, which are presented in Table 21, show the improvement in $D_{min}$ and color purity afforded by post exposure photobleaching.

TABLE 21

| Initial Status A[a] (RED) | | Initial Status A[a] (GREEN) | | Final Status A[b] (GREEN) | |
|---|---|---|---|---|---|
| $D_{min}$ | $D_{max}$ | $D_{min}$ | $D_{max}$ | $D_{min}$ | $D_{max}$ |
| 0.08 | 1.3 | 0.47 | 0.50 | 0.05 | 0.18 |

[a]prior to post-exposure blanket irradiation
[b]following post-exposure blanket irradiation Two strips of unexposed regions of the imaged, thermally processed, and blanket exposed sample were cut. Both strips had not been initially exposed with the imaging light source and so were essentially colorless. One strip was placed into an ammonia vapor chamber (equilibrium concentration with 30% aqueous ammonium hydroxide), while the other was not. Both strips were then placed on a Reichert Heizbank thermal gradient apparatus for 20 seconds and the thermal limits were measured. Also, Status A red densitometer readings (indicative of image-dye fog), were determined in areas that had been in contact with the 75° C. to 80° C. region of the Reichert Heizbank thermal gradient apparatus. The results are presented in Table 22.

TABLE 22

| | | Fog | |
|---|---|---|---|
| $NH_3$ Fix | Thermal Limit | 75° C. region | 80° C. region |
| none | 80 | 0.29 | 0.60 |
| 5 minutes | 150 | 0.07 | 0.08 |

The invention has been described in detail with particular reference to preferred embodiments thereof, but it will be understood that variations and modifications can be effected within the spirit and scope of the invention.

1

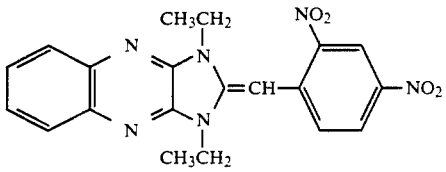

2

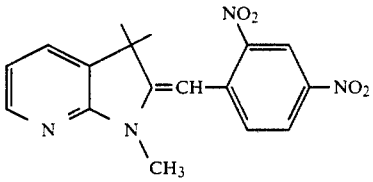

3

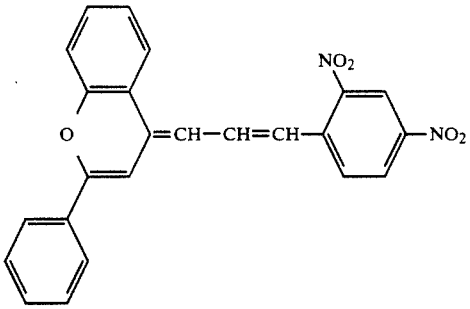

4

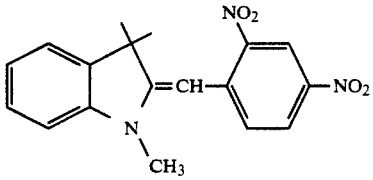

5

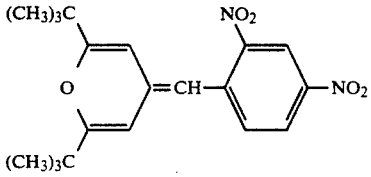

-continued

6

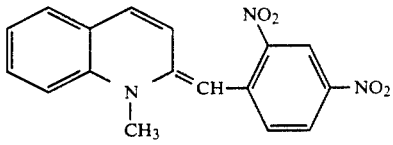

7

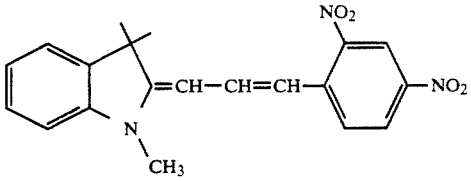

8

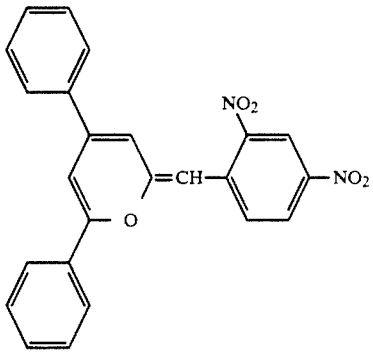

9

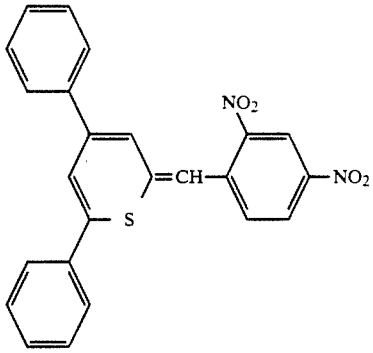

10

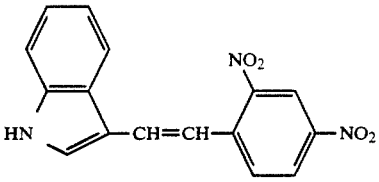

11

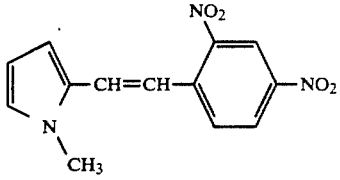

12

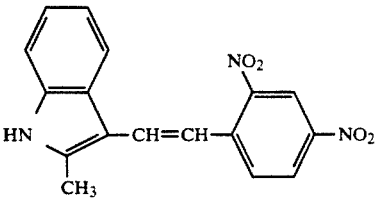

-continued
13
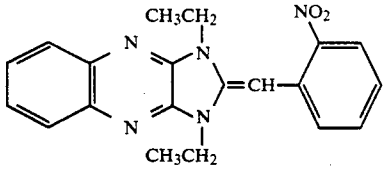
14
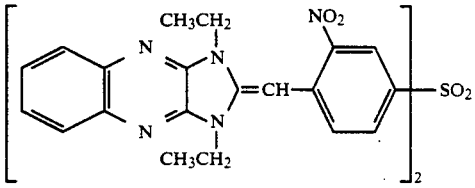
15
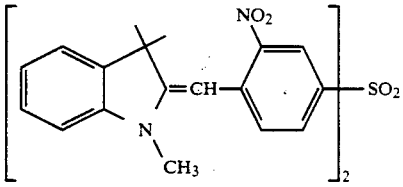
16
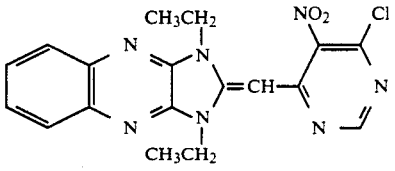
17
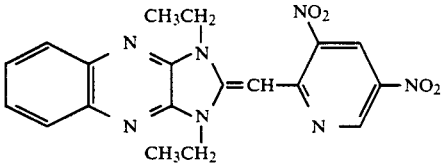
18
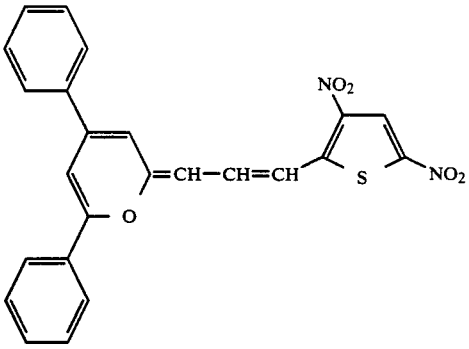
19
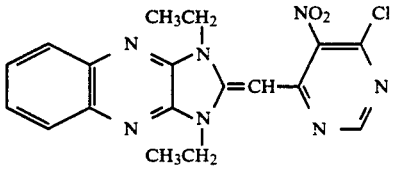
-continued
20
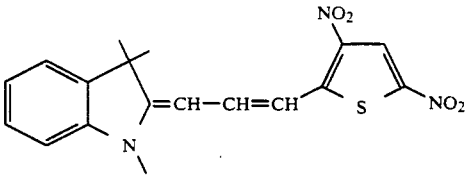
21
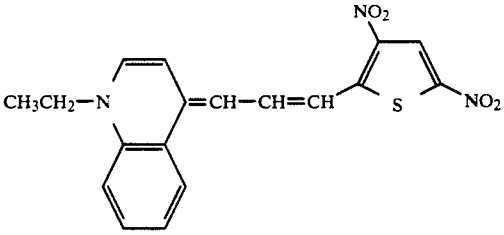
22
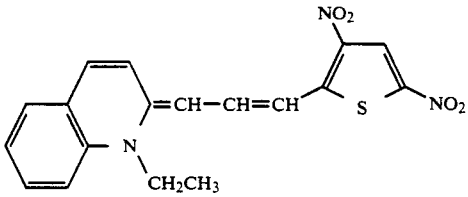
23
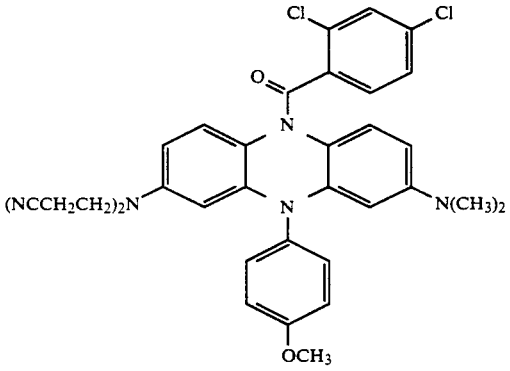
24
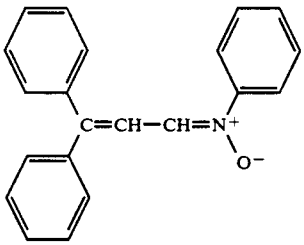
25
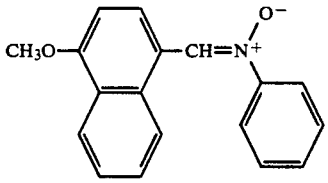
What is claimed is:
1. An imageable layer consisting essentially of a binder, at least one leuco dye, at least one compound which is a source of nitrate ion, and at least one photobleachable dye.

2. An imageable layer consisting essentially of a binder, at least one leuco dye, at least one compound which is a source of nitrate ion, at least one photobleachable dye, and at least one acidic component.

3. The imageable layer of claim 2 wherein said acid is an organic acid.

4. The imageable layer of claim 1 which, as parts by weight of said layer, comprises at least 0.5% leuco dye, at least 0.005% photobleachable dye, and at least 0.10 moles nitrate ion per mole of leuco dye.

5. The imageable layer of claim 1 wherein the said nitrate ion is present in the form of a metal salt of nitrate.

6. The imageable layer of claim 2 wherein said nitrate ion is in the layer as a metal nitrate salt, said leuco dye is present as at least 2% by weight of said layer, said o-nitroarylidene dye is present as from 0.005% to 8% by weight of said layer, and said binder comprises at least 80% by weight of said layer.

7. A process for forming an image comprising exposing the layer of claim 1 to light, heating the exposed layer to generate a visible image, and exposing the entire image to light to alleviate the background stain.

8. A process according to claim 7 in which the exposing of the entire image is followed by treatment with ammonia vapor to fix the image.

9. An imageable layer comprising a binder, at least one leuco dye, at least one compound which is a source of nitrate ion, and at least one photobleachable dye, said layer being free of free radical photoinitiators.

10. The imageable layer of claim 9 which, as parts by weight of said layer, comprises at least 0.5% leuco dye, at least 0.005% photobleachable dye, and at least 0.10 moles nitrate ion per mole of leuco dye.

11. The imageable layer of claim 9 wherein said nitrate ion is in the layer as a metal nitrate salt, said leuco dye is present as at least 2% by weight of said layer, said o-nitroarylidene dye is present as from 0.005% to 8% by weight of said layer, and said binder comprises at least 80% by weight of said layer.

12. An imageable layer comprising a binder, at least one leuco dye, at least one compound which is a source of nitrate ion, and at least one photobleachable dye, said layer being free of an ultraviolet radiation sensitive photoinitiator.

13. An imageable layer comprising a binder, at least one leuco dye, at least one compound which is a source of nitrate ion, at least one photobleachable dye, and at least one acidic component, said layer being free of an ultraviolet radiation sensitive photoinitiator.

14. The imageable layer of claim 13 wherein said acid is an organic acid.

15. The imageable layer of claim 12 which, as parts by weight of said layer, comprises at least 0.5% leuco dye, at least 0.005% photobleachable dye, and at least 0.10 moles nitrate ion per mole of leuco dye, and said nitrate ion is present in the form of a metal salt of nitrate.

16. An imageable layer consisting essentially of a binder, at least one leuco dye, at least one compound which is a source of nitrate ion, and at least one photobleachable dye, wherein the photobleachable dye is an o-nitroarylidene dye represented either by the Formula 1, Formula 2, Formula 3 where Formula 1 is

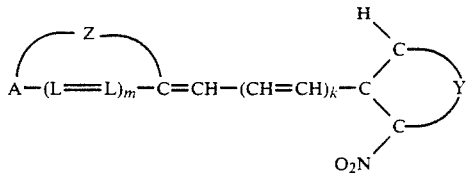

wherein:

a. k represents 0 or 1, b. m represents 0 or 1, c. each L represents a methine group, including substituted methine groups, d. A represents an electron donating moiety, sulfur, or;

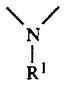

e. $R_1$ represents an alkyl group, an aralkyl group, a sulfoalkyl groups, a sulfatoalkyl group, an alkoxycarbonylalkyl group, an alkoxyalkyl group, an acyloxyalkyl group, an acyloxyalkyl group, a dialkylaminoalkylene group, a cycloaminoalkylene group, an alkenyl group or an aryl group, f. Z represents the nonmetallic atoms necessary to complete a cyanine dye type heterocyclic nucleus comprising 5 or 6 atoms in the heterocyclic ring containing A, in addition to which ring can contain a second hetero atom selected from the group consisting of oxygen, nitrogen, selenium, or sulfur atoms; and g. Y represents the atoms necessary to complete an aryl or heteroaromatic group; and where Formula 2 is

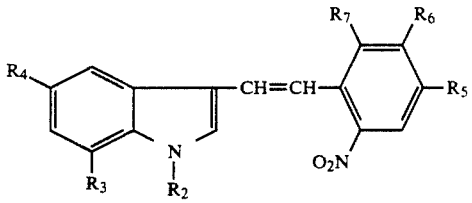

wherein:

$R_2$ represents hydrogen, an alkyl group of 1 to 24 carbon atoms or an aryl group of 6 to 10 carbon atoms, the alkyl or aryl group optionally substituted by halogen, by an alkyoxy group of 1 to 6 carbon atoms or by an aryl group of 6 to 10 carbon atoms;

$R_3$ and $R_4$ independently represent hydrogen, an alkyle group of 1 to 6 carbon atoms, an alkoxy group of 1 to 6 carbon atoms, or halogen:

$R_5$ represents hydrogen, nitro, cyano, a carboalkoxy group of 1 to 6 carbon atoms, or halogen; or $R_6$ and $R_7$ together constitute a benzo group; and where Formula 3 is

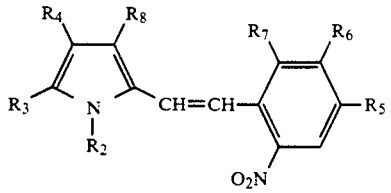

wherein $R_2$–$R_6$ are defined as above;

$R_8$ independently represents hydrogen, an alkyl group of 1 to 6 carbon atoms, an alkoxy group of 1 to 6 carbon atoms, or halogen.

17. The imageable layer of claim 16 wherein an organic acid is present in said layer.

18. An imageable layer consisting essentially of a binder, at least one leuco dye, at least one compound which is a source of nitrate ion, and at least one photobleachable dye, wherein the photobleachable dye is an aryl nitrone

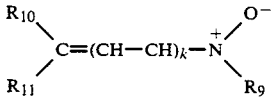

wherein k is 0 or 1;

$R_9$ is an aryl or substituted aryl group;

$R_{10}$ and $R_{11}$ are independently chosen from an electron rich substituted aryl or heterocyclic group and hydrogen, with the proviso that $R_{11}$ and $R_{12}$ are not both hydrogen.

19. The imageable layer of claim 18 wherein an organic acid is present in said layer.

20. An imageable layer comprising a binder, at least one leuco dye, at least one compound which is a source of nitrate ion, and at least one photobleachable dye, said layer being free of free radical photoinitiators, wherein the photobleachable dye is an o-nitroarylidene dye represented either by the Formula 1, Formula 2, or Formula 3 where Formula 1 is

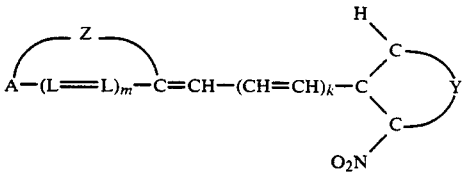

wherein a. k represents 0 or 1, b. m represents 0 or 1, c. each L represents a methine group, including substituted methine groups, d. A represents an electron donating moiety, sulfur, or;

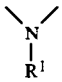

e. $R_1$ represents an alkyl group, an aralkyl group, a sulfoalkyl group, a sulfatoalkyl group, an alkoxycarbonylalkyl group, an alkoxyalkyl group, an acyloxyalkyl group, an acyloxyalkyl group, a dialkylaminoalkylene group, a cycloaminoalkylene group, a alkenyl group or an aryl group, f. Z represents the nonmetallic atoms necessary to complete a cyanine dye type heterocyclic nucleus comprising 5 or 6 atoms in the heterocyclic ring containing A, in addition to which ring can contain a second hetero atom selected from the group consisting of oxygen, nitrogen, selenium, or sulfur atoms; and g. Y represents the atoms necessary to complete an aryl or heteroaromatic group; and where Formula 2 is

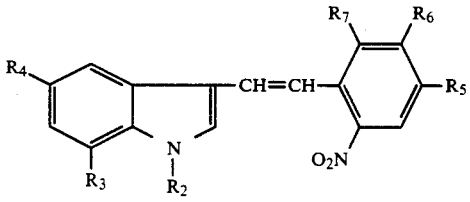

wherein:

$R_2$ represents hydrogen, an alkyl group of 1 to 24 carbon atoms or an aryl group of 6 to 10 carbon atoms, the alkyl or aryl group optionally substituted by halogen, by an alkoxy group of 1 to 6 carbon atoms or by an aryl group of 6 to 10 carbon atoms;

$R_3$ and $R_4$ independently represent hydrogen, an alkyl group of 1 to 6 carbon atoms, an alkoxy group of 1 to 6 carbon atoms, or halogen;

$R_5$ represents hydrogen, nitro, cyano, a carboalkoxy group of 1 to 6 carbon atoms, or halogen; or $R_6$ and $R_7$ together constitute a benzo group; and where Formula 3 is

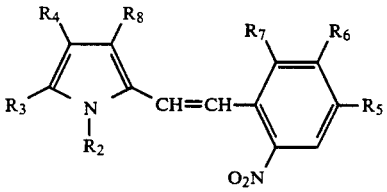

wherein $R_2$–$R_6$ are defined as above;

$R_8$ independently represents hydrogen, an alkyl group of 1 to 6 carbon atoms, an alkoxy group of 1 to 6 atoms, or halogen.

21. An imageable layer comprising a binder, at least one leuco dye, at least one compound which is a source of nitrate ion, and at least one photobleachable dye, said layer being free of free radical photoinitiators, wherein the photobleachable dye is an aryl nitrone

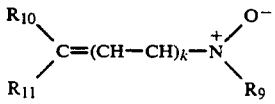

wherein k is 0 or 1;

$R_9$ is an aryl or substituted aryl group;

$R_{10}$ and $R_{11}$ are independently chosen from an electron rich substituted aryl or heterocyclic group and hydrogen, with the previous that $R_{11}$ and $R_{12}$ are not both hydrogen.

22. An imageable layer comprising a binder, at least one leuco dye, at least one compound which is a source of nitrate ion, and at least one photobleachable dye, said layer being free of an ultraviolet radiation sensitive photoinitiator, wherein the photobleachable dye is an o-nitroarylidene dye represented either by the Formula 1, Formula 2, or Formula 3 where Formula 1 is

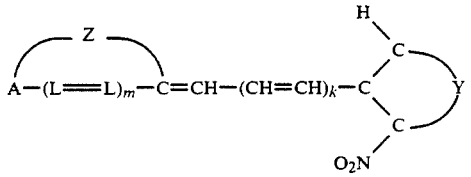

wherein:

a. k represents 0 or 1, b. m represents 0 or 1, c. each L represents a methine group, including substituted methine groups, d. A represents an electron donating moiety, sulfur, or:

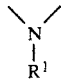

e. $P_1$ represents an alkyl group, an aralkyl group, a sulfatoalkyl group, a sulfatoalkyl group, an alkoxycarbonylalkyl group, an alkoxyalkyl group, an acyloxyalkyl group, an acyloxyalkyl group, a dialkylaminoalkylene group, a cycloaminoalkylene group, an alkenyl group or an aryl group, f. Z represents the nonmetallic atoms necessary to complete a cyanine dye type heterocyclic nucleus comprising 5 or 6 atoms in the heterocyclic ring containing A, in addition to which the ring can contain a second hetero atom selected from the group consisting of oxygen, nitrogen, selenium, or sulfur atoms; and g. Y represents the atoms necessary to complete an aryl or heteroaromatic group; and where Formula 2 is

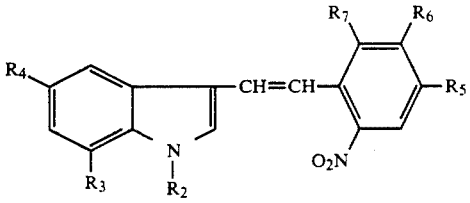

wherein:

$R_2$ represents hydrogen, an alkyl group of 1 to 24 carbon atoms or an aryl group or 6 to 10 carbon atoms, the alkyl or aryl group optionally substituted by halogen, by an alkoxy group of 1 to 6 carbon atoms or by an aryl group of 6 to 10 carbon atoms;

$R_3$ and $R_4$ independently represent hydrogen, an alkyle group of 1 to 6 carbon atoms, an alkyoxy group of 1 to 6 carbon atoms, or halogen;

$R_5$ represents hydrogen, nitro, cyano, a carboalkoxy group of 1 to 6 carbon atoms, or halogen; or $R_6$ and $R_7$ together constitute a benzo group; and where Formula 3 is

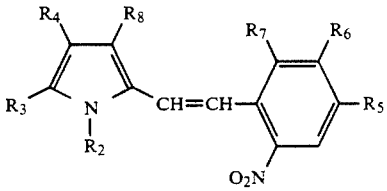

wherein:

$R_2$–$R_6$ are defined as above;

$R_8$ independently represents hydrogen, alkyl group of 1 to 6 carbon atoms, an alkoxy group of 1 to 6 carbon atoms, or halogen.

* * * * *

UNITED STATES PATENT AND TRADEMARK OFFICE

CERTIFICATE OF CORRECTION

PATENT NO. : 5,153,105

DATED : October 6, 1992

INVENTOR(S) : Sher et al.

It is certified that error appears in the above-identified patent and that said Letters Patent is hereby corrected as shown below:

Col. 9, line 26 "chrominum" should be -- chromium --

Col. 14, line 48, "8'" should be --8"--.

Col. 19, line 31 "Of" should be -- of --

Col. 31, line 62 "present" should be -- presently --

Signed and Sealed this

Twelfth Day of April, 1994

Bruce Lehman

BRUCE LEHMAN

*Commissioner of Patents and Trademarks*

*Attest:*

*Attesting Officer*